United States Patent [19]

Ando et al.

[11] 4,450,824

[45] May 29, 1984

[54] EXHAUST GAS RECIRCULATION CONTROL SYSTEM WITH ATMOSPHERIC PRESSURE COMPENSATION VALVE

[75] Inventors: Ken Ando; Masaaki Tanaka; Michio Kawagoe, all of Toyota, Japan

[73] Assignee: Toyota Jidosha Kabushiki Kaisha, Toyota, Japan

[21] Appl. No.: 429,238

[22] Filed: Sep. 30, 1982

[30] Foreign Application Priority Data

Jun. 15, 1982 [JP] Japan ..... 57-103169

[51] Int. Cl.[3] ..... F02M 25/06; F02M 23/00

[52] U.S. Cl. ..... 123/569; 123/568; 123/571; 123/585

[58] Field of Search ..... 123/571, 568, 569, 585, 123/586, 588

[56] References Cited

U.S. PATENT DOCUMENTS

| | | | |
|---|---|---|---|
| 4,237,837 | 12/1980 | Toda et al. | 123/569 |
| 4,365,608 | 12/1982 | Bradshaw et al. | 123/568 |
| 4,369,753 | 1/1983 | Sugiyama | 123/569 |
| 4,387,693 | 6/1983 | Romblom | 123/569 |

FOREIGN PATENT DOCUMENTS

| | | | |
|---|---|---|---|
| 57-108449 | 7/1982 | Japan | 123/569 |
| 57-108450 | 7/1982 | Japan | 123/569 |
| 57-157045 | 9/1982 | Japan | 123/569 |
| 57-157047 | 9/1982 | Japan | 123/569 |
| 57-157048 | 9/1982 | Japan | 123/569 |
| 57-171057 | 10/1982 | Japan | 123/569 |

*Primary Examiner*—Wendell E. Burns

*Attorney, Agent, or Firm*—Oblon, Fisher, Spivak, McClelland & Maier

[57] ABSTRACT

In a diesel engine exhaust gas recirculation system wherein an exhaust gas recirculation control valve operated by an operating air pressure controls the flow resistance of the exhaust gas recirculation passage according to variation of the operating air pressure effected by an operating air pressure control valve according to the load on the engine so as to replace most of the excess air part of the intake air by recirculated exhaust gases, an atmospheric pressure responsive air pressure control valve is provided so as to supply an air pressure which has been beforehand controlled so as to compensate for such changes of atmospheric pressure as caused by changes of altitude to the operating air pressure control valve as an operating air pressure source.

10 Claims, 9 Drawing Figures

EXHAUST GAS RECIRCULATION CONTROL SYSTEM WITH ATMOSPHERIC PRESSURE COMPENSATION VALVE

BACKGROUND OF THE INVENTION

The present invention relates to the general field of exhaust gas recirculation for diesel internal combustion engines, and more particularly relates to an exhaust gas recirculation control system for a diesel internal combustion engine which incorporates altitude compensation, so that changes of atmospheric pressure due to changes of operating altitude of the diesel internal combustion engine do not cause exhaust gas recirculation to be performed in an incorrect amount.

Nowadays it is common to provide exhaust gas recirculation for a diesel internal combustion engine, i.e. to provide an exhaust gas recirculation conduit which recirculates a portion of the exhaust gases produced by the diesel internal combustion engine and being expelled through its exhaust system to an intermediate point in the air intake system thereof. In most operating conditions, a diesel internal combustion engine is being operated in the so called excess air mode, in which substantially more air is being sucked into the air intake system thereof than is required for combusting the fuel which is being injected into the combustion chambers. Therefore, provided that such recirculated exhaust gases only replace a part of all of the excess air which is being sucked into the combustion chambers of the diesel internal combustion engine, and provided thus that the process of replacing intake air by recirculated exhaust gases is not taken so far as to replace some of the air that is actually being utilized for combusting the fuel injected into the combustion chambers of the diesel internal combustion engine, no difficulty will arise with regard to availability of oxygen for combusting such injected fuel. This process of exhaust gas recirculation for a diesel internal combustion engine has the beneficial effect that it reduces the emissions of nitrogen oxides (generically denoted as NOx) in the exhaust gases of the diesel internal combustion engine, without increasing the amount of smoke or soot in the exhaust gases and without deteriorating the drivability of the diesel internal combustion engine and of the vehicle incorporating said engine.

However, this requires that the amount of exhaust gas recirculation provided for the diesel internal combustion engine be varied according to the amount of excess air which is being inhaled through its intake passage by the engine. If too much exhaust gas recirculation is provided to the diesel internal combustion engine then there is a risk of incomplete combustion of fuel in the combustion chambers thereof, which can lead to the emission of smoke and soot in the exhaust of the engine, and also the drivability of the vehicle incorporating the diesel internal combustion engine is unfavorably deteriorated. Provision of a proper amount of exhaust gas recirculation for the diesel internal combustion engine is typically done by providing an exhaust gas recirculation control valve assembly at an intermediate position in the abovementioned exhaust gas recirculation passage which conducts the recirculated exhaust gases from the exhaust system of the diesel internal combustion engine to its air intake system, so that according to the amount of opening of this exhaust gas recirculation control valve assembly the flow resistance of the exhaust gas recirculation passage and the amount of exhaust gases passing therealong are controlled.

Since the amount of excess air which is being inhaled by the combustion chambers of the diesel internal combustion engine depends upon the load upon the engine, so that, roughly, the lower is the load on the diesel internal combustion engine, the greater is the proportion of the inhaled excess air, in order properly to control the amount of exhaust gas recirculation, the amount of opening of the aforementioned exhaust gas recirculation control valve, should be increased in response to a decrease in the load on the diesel internal combustion engine; and, vice versa, should be decreased in response to an increase in the load.

Typically the load on a diesel internal combustion engine, i.e. the power output produced thereby, is regulated by controlling the amount of fuel injected into the combustion chamber or chambers thereof, by contrast to the case with a gasoline internal combustion engine incorporating a carburetor, in which the amount of intake air flow is regulated. Thus, when the diesel internal combustion engine is required to produce a considerably high power output, then a considerable amount of fuel is injected into each combustion chamber thereof at each of its compression strokes; and vice versa. Accordingly, the amount of exhaust gas recirculation should be regulated according to the amount of fuel provided per each injection pulse into the combustion chambers of the diesel internal combustion engine by the fuel injection pump, and should therefore be regulated according to the movement of a fuel metering member or the like of said fuel injection pump.

A prior art form of diesel engine exhaust gas recirculation control system has been developed by a colleague of the present inventors, for which previous concept Japanese Patent Application No. 102030/80 has been filed previously to the filing of the parent Japanese patent application No. 103169/82 of the present application of which priority is being claimed in the present application, said previously applied Japanese patent application relating to said prior art concept being assigned to the same assignee as said parent Japanese patent application of the present application; and the present inventors hereby desire to acknowledge their debt to this previous proposal. In this previous proposal, an exhaust gas recirculation control valve assembly of the sort described above was driven by supply of a control operating air pressure to a diaphragm chamber incorporated therein, and this control operating air pressure was provided by an operating air pressure control valve, which received a supply of operating air pressure from an operating air pressure pump and which regulated this operating air pressure according to the position of a fuel metering element of the fuel injection pump of the diesel internal combustion engine, so as to produce the control operating air pressure. Thus the amount of exhaust gas recirculation through the exhaust gas recirculation passage was regulated by the exhaust gas recirculation control valve assembly in response to changes in the load on the diesel internal combustion engine, being increased in response to a decrease in the load and being decreased in response to an increase in the load.

In more detail, the operating air pressure control valve in the above identified prior art included a pressure adjustment chamber which was supplied with the operating air pressure from the operating air pressure pump, and a certain amount of atmospheric air was bled into this pressure adjustment chamber so as to produce the abovementioned control operating air pressure for controlling the exhaust gas recirculation control valve assembly, the amount of bled in air being dependent upon the position of the above identified fuel metering elment of the fuel injection pump of the diesel internal combustion engine.

This system was effective for controlling exhaust gas recirculation, but it suffered from the problem that it did not incorporate any system for compensating for changes in atmospheric pressure. Now, when a vehicle incorporating this exhaust gas recirculation control system is being used at high altitude, of course the pressure of the atmospheric air drops very substantially, and accordingly the efficiency of the diesel internal combustion engine at sucking in air through its air intake system drops very drastically. Thus, at high altitude, the amount of excess air which is inhaled into the combustion chambers of the diesel internal combustion engine, for a given value of the load, is drastically reduced. If therefore the same performance of provision of exhaust gas recirculation for the diesel internal combustion engine with relation to the load thereon is practiced at high altitude, as was practiced at sea level when the atmospheric pressure was the normal value of about 760 mmHg, then substantially too much exhaust gas recirculation will be provided, and the danger of smoking or soot production of the diesel internal combustion engine, as well as emission of noxious exhaust gas components and lack of drivability, becomes very severe. In other words, the amount of exhaust gas recirculation provided for the diesel internal combustion engine, relative to a given load thereon, should be regulated according to the altitude, and should be diminished more and more, the higher is the altitude.

Now, in consideration of the above described problem, another prior art form of diesel engine exhaust gas recirculation control system has been developed by one of the inventors of the invention described in the present application, for which previous concept Japanese Patent Application No. 40809/81 has been filed previously to the filing of the parent Japanese patent application No. 103169/82 of the present application of which priority is being claimed in the present application, said previously applied Japanese patent application relating to said prior art concept being assigned to the same assignee as said parent Japanese patent application of the present application. In this previous proposal, an atmospheric pressure compensating valve was provided, which was communicated to an intermediate portion of the operating air pressure conduit which linked the operating air pressure control valve to the diaphragm actuator of the exhaust gas recirculation control valve assembly. This atmospheric pressure compensation valve included an aneroid bellows, which responded to the actual current value of atmospheric pressure, and according to this current value of atmosphereic pressure the atmospheric pressure compensation valve selectively bled a supply of atmospheric air into the aforesaid operating air pressure conduit which linked the operating air pressure control valve to the diaphragm actuator of the exhaust gas recirculation control valve assembly and which conducted the control operating air pressure from the operating air pressure control valve to said diaphragm actuator of the exhaust gas recirculation control valve assembly, so as to selectively decrease the actuating operating air pressure within said diaphragm actuator, and thus selectively to diminish the amount of exhaust gas recirculation provided to the diesel internal combustion engine.

However, this arrangement was not entirely satisfactory, because the operating air pressure control valve was still trying to regulate the operating air pressure within its pressure adjustment chamber, which was supplied through the aforesaid operating air pressure conduit, which linked the operating air pressure control valve to the diaphragm actuator of the exhaust gas recirculation control valve assembly, and at an intermediate portion of which the atmospheric pressure compensation valve was provided, so as to bring the operating air pressure value therein to be equal to the operating air pressure value which would be appropriate for controlling the exhaust gas recirculation control valve assembly properly during vehicle operation at sea level when the atmospheric pressure was normal, as long as the load on the engine or the amount of the fuel supply was not changed. The action of the operating air pressure control valve in regulatling the operating air pressure within its pressure adjustment chamber to produce said control operating air pressure for the exhaust gas recirculation control valve assembly was to generate a certain operating air pressure in the pressure adjustment chamber according to the signal of engine load given thereto. Therefore, if the control operating air pressure generated in the pressure adjustment chamber was modified toward atmospheric pressure by atmospheric air being bled into the operating air pressure conduit leading from the pressure adjustment chamber to the diaphragm actuator of the exhaust gas recirculation control valve, at the atmospheric pressure compensation valve, the operating air pressure control valve still operated further to cancel the modification effected by the atmospheric pressure compensation valve. The effect of operation of the atmospheric pressure compensation valve could be manifested when a relatively high flow resistance was provided in the operating air pressure conduit between the operating air pressure control valve and the atmospheric pressure compensation value. However, such a flow resistance would damage the responsiveness of the control system.

Finally, in order to improve the efficiency of recirculation of exhaust gases through such an exhaust gas recirculation passage, especially in conditions of low engine load, it is known to provide a throttling valve in the air intake passage of the diesel internal combustion engine, upstream of the point in said air intake passage to which the downstream end of the exhaust gas recirculation passage communicates. Thus, when this throttling valve is operated so that it causes the flow resistance of the air intake passage to be increased at that point therein, the depression below the current value of atmospheric pressure at the downstream end of the exhaust gas recirculation passage is increased, which as a matter of course helps to suck the exhaust gases through said exhaust gas recirculation passage and thus promotes exhaust gas recirculation. However, the problem has arisen of regulating the operation of such an intake air throttling valve according to the current value of atmospheric pressure, again, and this has not yet been adequately solved, in the prior art.

SUMMARY OF THE INVENTION

Accordingly, it is the primary object of the present invention to provide such a diesel exhaust gas recirculation control system for a diesel internal combustion engine, which provides proper compensation for changes in atmospheric pressure.

It is a further object of the present invention to provide such a diesel exhaust gas recirculation control system for a diesel internal combustion engine, which provides proper compensation for changes in operating altitude of a vehicle incorporating said diesel internal combustion engine.

It is a further object of the present invention to provide such a diesel exhaust gas recirculation control system for a diesel internal combustion engine, which is able to provide a good and appropriate amount of exhaust gas recirculation for said engine, whatever may be the operating altitude of the vehicle incorporating said engine.

It is a further object of the present invention to provide such a diesel exhaust gas recirculation control system for a diesel internal combustion engine, which utilizes an operating air pressure control valve of the bleeding type explained above, and which operates appropriately in all operating conditions of the diesel internal combustion engine.

It is a further object of the present invention to provide such a diesel exhaust gas recirculation control system for a diesel internal combustion engine, which combines such adjustment of the amount of exhaust gas recirculation provided to the diesel internal combustion engine, as explained above, with respect to operational altitude, with proper adjustment of the control of an intake system throttling valve, also of the sort explained above, with respect to operating altitude.

It is a further object of the present invention to provide such a diesel exhaust gas recirculation control system for a diesel internal combustion engine, which does not run the risk of emitting undue smoke or soot, even during operation of the diesel internal combustion engine at high altitude.

It is a further object of the present invention to provide such a diesel exhaust gas recirculation control system for a diesel internal combustion engine, which does not run the risk of emitting undue noxious components in the exhaust gases of the diesel internal combustion engine, even during operation of the diesel internal combustion engine at high altitude.

It is a further object of the present invention to provide such a diesel exhaust gas recirculation control system for a diesel internal combustion engine, which does not run the risk of poor drivability of the diesel internal combustion engine, even during operation of the diesel internal combustion engine at high altitude.

It is a further object of the present invention to provide such a diesel exhaust gas recirculation control system for a diesel internal combustion engine, which properly modifies the amount of exhaust gas recirculation provided for the diesel internal combustion engine, according to the current value of engine load and the actual atmospheric pressure.

It is yet a further object of the present invention to provide such a diesel exhaust gas recirculation control system for a diesel internal combustion engine, which does not suffer from the disadvantage explained above with relation to the prior art.

It is yet a further object of the present invention to provide such a diesel exhaust gas recirculation control system for a diesel internal combustion engine, which is simple in construction.

It is yet a further object of the present invention to provide such a diesel exhaust gas recirculation control system for a diesel internal combustion engine, which is reliable in operation.

It is yet a further object of the present invention to provide such a diesel exhaust gas recirculation control system for a diesel internal combustion engine, which is cheap to manufacture.

It is yet a further object of the present invention to provide such a diesel exhaust gas recirculation control system for a diesel internal combustion engine, which gives good drivability for the engine and for the vehicle incorporating said engine.

According to the present invention, these and other objects are accomplished by, for a diesel internal combustion engine for a vehicle, comprising an air intake passage, an exhaust passage, and an exhaust gas recirculation passage whose upstream end is communicated to an intermediate point of said exhaust passage and whose downstream end is communicated to an intermediate point of said air intake passage: an exhaust gas recirculation control system, comprising: (a) a source of operating air pressure; (b) an atmospheric pressure compensation valve, comprising an operating air pressure intake port and an operating air pressure output port, which receives a supply of said operating air pressure at its said operating air pressure intake port, and selectively bleeds atmospheric air into said supply of intake operating air pressure so as to produce a supply of atmospheric pressure compensated operating air pressure at its said operating air pressure output port, the amount by which the pressure value of said atmospheric pressure compensated output operating air pressure is deviated from the current value of atmospheric pressure diminishing as the absolute value of atmospheric pressure diminishes; (c) an operating air pressure control valve, comprising an operating air pressure intake port and an operating air pressure output port, which receives a supply of said atmospheric pressure compensated operating air pressure from said operating air pressure output port of said atmospheric pressure compensation value at its said operating air pressure intake port, and which selectively bleeds atmospheric air into said supply of atmospheric pressure compensated operating air pressure according to the value of the load on said diesel internal combustion engine so as to produce a supply of control operating air pressure at its said operating air pressure output port; the deviation from the current value of atmospheric pressure of said control operating air pressure either being equal to a target depression value which is determined according to said load on said diesel internal combustion engine, or being equal to the deviation value of said supply of atmospheric pressure compensated operating air pressure from said operating air pressure output port of said atmospheric pressure compensation valve, whichever is the less; and (d) an operating air pressure operated exhaust gas recirculation control valve comprising an operating air pressure intake port, which receives a supply of said control operating air pressure from said operating air pressure output port of said operating air pressure control valve at its said operating air pressure intake port, and which controls the flow resistance of said exhaust gas recirculation passage according to the difference between the current value of atmospheric pressure and the current pressure value of said control operating air pressure supplied to its said operating air pressure intake port, so as to decrease said flow resistance from a maximum substantially infinite value such as to allow exhaust gas recirculation when the deviation from the current value of atmospheric pressure of said control operating air pressure increases beyond a certain predetermined value.

According to such a structure, as the altitude at which the vehicle is being operated increases and the atmopheric pressure accordingly diminishes, the amount of deviation from the current value of atmospheric pressure of the atmospheric pressure compensated operating air pressure outputted by the atmospheric pressure compensated valve decreases; this will have no substantial effect on the control operating air pressure outputted from the operating air pressure control valve, as long as the value of this deviation from atmospheric pressure of the atmospheric pressure compensated operating air pressure remains greater than the target value of deviation for said control operating air pressure, based upon the current value of load of the diesel internal combustion engine; in other words, the operating air pressure control valve will remain able to output a control operating air pressure of the target deviation value, as long as sufficient deviatoin from atmospheric pressure of the atmospheric pressure compensated operating air pressure outputted from the atmospheric pressure compensating valve is available. This is a consequence of the fact that the operating air pressure control valve operates to produce said control operating air pressure by selectively bleeding atmospheric air into said supply of atmospheric pressure compensated operating air pressure outputted from the atmospheric pressure compensating valve, and therefore as a matter of course can only operate to reduce the deviation value of said atmospheric pressure compensated operating air pressure, not to increase it. On the other hand, if at any time the amount of deviation from the current value of atmospheric pressure of the atmospheric pressure compensated operating air pressure outputted by the atmospheric pressure compensating valve decreases below the target value of deviation from the current atmospheric pressure for said control operating air pressure outputted from the operating air pressure control valve, based upon the current value of load of the diesel internal combustion engine, then the operating air pressure value of said outputted control operating air pressure becomes, at the most, equal to the operating air pressure value of said atmospheric pressure compensated operating air pressure which is less than the target operating air pressure value, since although of course in these circumstances the operating air pressure control valve is not bleeding any atmospheric air into said atmospheric pressure compensated operating air pressure supply, nevertheless said operating air pressure control valve of course cannot actually increase the deviation value of said atmospheric pressure compensated operating air pressure. In other words, as the altitude at which the vehicle is being operated increases and the atmospheric pressure accordingly diminishes, the amount of deviation from the current value of atmospheric pressure of the atmospheric pressure compensated operating air pressure outputted by the atmospheric pressure compensating valve decreases, and serves as a ceiling value for the amount of deviation from the current value of atmospheric pressure of the control operating air pressure which is outputted by the vacum control valve and is used for operating the exhaust gas recirculation control valve assembly, bringing down the deviation value of said control operating air pressure to its own deviation value, if the deviation of said control operating air pressure would otherwise be higher than said deviation of said atmospheric pressure compensated operating air pressure. This ceiling effect has the effect of reducing the amount of exhaust gas recirculation provided by the exhaust gas recirculation control valve assembly to the diesel internal combustion engine in these circumstances, since the exhaust gas recirculation control valve assembly is so constituted, as explained above, to present a greater resistance to the flow of recirculated exhaust gases through the exhaust gas recirculation passage, the less is the deviation of said conrol operating air pressure from the current value of atmospheric pressure. Since it will typically be the case that the target value for the deviation from the current value of atmospheric pressure of the control operating air pressure outputted from the operating air pressure control valve is high in conditions of low engine load and diminishes as the engine load increases, this ceiling effect of curtailing the maximum valve of deviation from the current value of atmospheric pressure of the control operating air pressure outputted by the vacum control valve has the effect of providing less exhaust gas recirculation for the diesel internal combustion engine, when the value of the load on the diesel internal combustion engine is low, at high altitude than at low altitude; and this altitude moderation effect on the quality of exhaust gas recirculation is definitely pronounced. Accordingly, proper compensation for changes in atmospheric pressure and operating altitude is provided; and the provision of a good and appropriate amount of exhaust gas recirculation for said diesel internal combustion engine is assured, whatever may be the operating altitude of the vehicle incorporating said engine. Further, the exhaust gas recirculation control system whose structure and function are as described above does not run the risk of emitting undue smoke or soot from the diesel internal combustion engine, even during operation of the diesel internal combustion engine at the low atmospheric pressure characteristic of high altitudes. Nor is the risk run of emitting undue noxious components in the exhaust gases of the diesel internal combustion engine, even during operation of the diesel internal combustion engine at high altitude. Also, the diesel exhaust gas recirculation control system for a diesel internal combustion engine according to the present invention does not run the risk of poor drivability of the diesel internal combustion engine, even during such operation of the diesel internal combustion engine at high altitude, because it properly modifies the amount of exhaust gas recirculation provided for the diesel internal combustion engine, according to the current value of engine load, in a fashion which is compensated for atmospheric pressure variations. This is made possible, according to the present invention, by an exhaust gas recirculation control system which is simple and which will be reliable in service, and which yet is cheap to manufacture. Accordingly the drivability of the diesel internal combustion engine is advantageously promoted.

Further, according to a particular aspect of the present invention, these and other objects are more particularly and concretely accomplished by an exhaust gas recirculation control system of the type described above, wherein the amount by which said atmospheric pressure compensated output operating air pressure of said atmospheric pressure compensation valve is deviated from the current value of atmospheric pressure diminishes steadily as the absolute value of atmospheric pressure diminishes.

According to such a structure and function, because the deviation of the atmospheric pressure compensated operating air pressure below the current value of atmospheric pressure drops steadily as atmospheric pressure drops, accordingly the magnitude of the above described ceiling effect, of curtailing the maximum amount of exhaust gas recirculation provided to the diesel internal combustion engine when atmospheric pressure is low, is steadily increased, as atmospheric pressure diminishes.

Further, according to a particular aspect of the present invention, these and other objects are more particularly and concretely accomplished by an exhaust gas recirculation control system of the type first described above, further comprising an operating air pressure operated intake passage choking valve comprising an operating air pressure intake port, which receives a supply of said control operating air pressure from said operating air pressure output port of said operating air pressure control valve at its said operating air pressure intake port, and which controls the flow resistance of said air intake passage at a point therein upstream of said intermediate point thereof to which said air intake passage is communicated according to the difference between the current value of atmospheric pressure and said control operating air pressure supplied to its said operating air pressure intake port, so as to increase said flow resistance value as the deviation from the current value of atmospheric pressure of said control operating air pressure increases.

According to such a structure, this intake passage choking valve is operated by the same control operating air pressure as is used for operating the exhaust gas recirculation control valve assembly. Accordingly, the ceiling effect of curtailing the maximum value of deviation from the current value of atmospheric pressure of the control operating air pressure which is outputted by the vacum control valve when the atmospheric pressure is low also has the effect of providing less intake passage throttling for the diesel internal combustion engine, when the value of the load on the diesel internal combustion engine is low, at high altitude than at low altitude; and this altitude moderation effect on the quantity of intake passage throttling is also definitely pronounced. This effect of moderating the amount of intake passage throttlling according to the altitude operates synergistically with the effect of moderating the amount of exhaust gas recirculation provided through the exhaust gas recirculation passage according to the altitude, to further provide proper compensation for changes in atmospheric pressure and operating altitude; and the provision of a good and appropriate amount of exhaust gas recirculation for said diesel internal combustion engine is thus further assured, whatever may be the operating altitude of the vehicle incorporating said engine. Further, by such additional intake passage choking, the exhaust gas recirculation control system whose structure and function are as described above is further guarded from the risk of emitting undue smoke or soot, or of emitting undue noxiou components in the exhaust gases of the diesel internal combustion engine, even during operation of the diesel internal combustion engine at high altitude. Also, by such additional intake passage choking, the diesel exhaust gas recirculation control system for a diesel internal combustion engine according to the present invention further ensures good drivability of the diesel internal combustion engine, even during such operation of the diesel internal combustion engine at high altitude, because it further properly modifies the amount of exhaust gas recirculation provided for the diesel internal combustion engine, by such intake passage choking which helps to suck a larger amount of exhaust gases through the exhaust gas recirculation passage, according to the current value of engine load, in a fashion which is compensated for atmospheric pressure variations. Accordingly the drivability of the diesel internal combustion engine is further advantageously promoted.

BRIEF DESCRIPTION OF THE DRAWINGS

The present invention will now be shown and described with reference to several preferred embodiments thereof, and with reference to the illustrative drawings. It should be clearly understood, however, that the description of the embodiments, and the drawings, are all of them given purely for the purposes of explanation and exemplification only, and are none of them intended to be limitative of the scope of the present invention in any way, since the scope of the present invention is to be defined soley by the legitimate and proper scope of the appended claims.

In the drawings.

DESCRIPTION OF THE PREFERRED EMBODIMENTS

Figure 1:
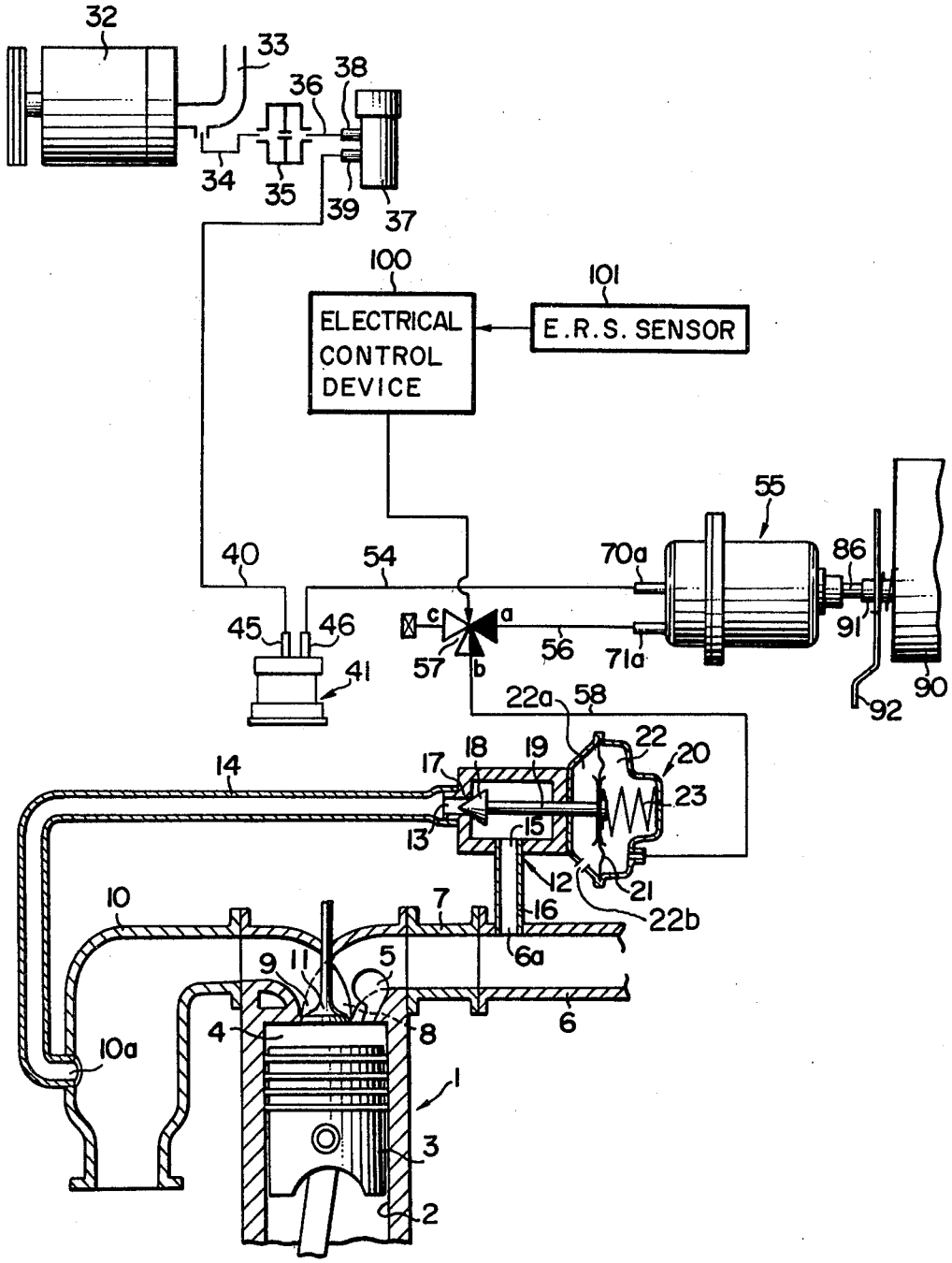
FIG. 1 is a partly schematic partly cross sectional view, showing the essential parts of a first preferred embodiment of the diesel exhaust gas recirculation control system according to the present invention, and also showing relevant parts of a diesel internal combustion engine of a per se well known sort the exhaust gas recirculation of which is being controlled thereby.

The present invention will now be described with reference to several preferred embodiments thereof, and with reference to the appended drawings. FIG. 1 shows in partly schematic partly cross sectional view the essential parts of a preferred embodiment of the diesel exhaust gas recirculation control system according to the present invention, which is being used for controlling a particular diesel internal combustion engine 1 of a per se well known sort and is adapted to be operated by vacuum as the operating air pressure. The diesel internal combustion engine 1 comprises a crankshaft which rotates in a per se well known fashion and an air intake passage 6 through which said diesel internal combustion engine 1 sucks air into its combustion chambers, one of which is shown and is designated by the reference numeral 4, being defined above a piston 3 which reciprocatingly slides in a cylinder bore 2 by being driven from said crankshaft of the diesel internal combustion engine 1 via a connecting rod in a per se well known manner. The air intake passage 6 communicates to the combustion chamber 4 via an intake manifold 7 and an intake port 8 which is controlled by a poppet type intake valve 11. The diesel engine 1 further comprises an exhaust passage 10, which communicates to the combustion chamber 4 via an exhaust port 9, which is controlled by a poppet type exhaust valve which cannot be seen in FIG. 1 because it is directly behind the intake valve 11 from the point of view of the drawing. Through the exhaust passage 10, the diesel internal combustion engine 1 exhausts the exhaust gases which are produced by combustion in said combustion chambers including the combustion chamber 4.

Pulses of diesel fuel of appropriate magnitude are injected into the combustion chamber 4 of the diesel internal combustion engine 1 at appropriate timing instants through a fuel injection nozzle not shown in the figures which is fitted to a vortex chamber 5 which opens to said combustion chamber 4 by a fuel injection pump 90, which may be a per se well known sort of diesel fuel injection pump such as a Bosch type VE fuel injection pump, and which is driven via a belt type transmission device or the like by the crankshaft of the diesel internal combustion engine 1 in a fixed phase relationship with respect thereto. The amount of diesel fuel injected in each pulse of fuel injection provided by the fuel injection pump 90 through the fuel injection nozzles for the various cylinders of the diesel internal combustion engine 1, including the nozzle relating to the combustion chamber 4, which of course corresponds to the load on the diesel internal combustion engine 1, is in fact determined according to the rotational position of a pump shaft 91 of the fuel injection pump 90, to which there is rotationally coupled a pump lever 92, so that said pump lever 92 rotationally drives said pump shaft 91. Although it is not particularly so shown in the figure, the pump lever 92 is rotationally driven by a linkage connected to an accelerator pedal fitted to the vehicle which is powered by the diesel internal combustion engine 1, said accelerator pedal being adapted to be depressed by the foot of an operator or driver of said vehicle, and said accelerator pedal, when so depressed, rotating the pump lever 92 and the pump shaft 91 in such a rotational direction as to increase the amount of diesel fuel provided by the fuel injection pump 90 to the combustion chambers including the combustion chamber 4 of the diesel internal combustion engine 1, i.e. in such a rotational direction as to increase the load on the diesel internal combustion engine 1. However, as an alternative, the amount of fuel provided in one fuel injection pulse by the fuel injection pump 90 could be arranged to depend on the position of a metering member which was positioned by a governor mechanism of any of several per se well known sorts, the relevant members being included in the pump 90, and the position of the pump shaft 91 and of the pump lever 92 could be arranged to be an input to this governor mechanism.

The upstream end of the upstream portion 14 of an exhaust gas recirculation passage is connected to an exhaust gas take out port 10*a* which is provided at an intermediate part of the exhaust passage 10, so that a part of the flow of the exhaust gases which have been produced by combustion in the combustion chambers including the combustion chamber 4 of the diesel internal combustion engine 1 and which are flowing through said exhaust passage 10 is diverted so as instead to flow into said upstream end of said upstream portion 14 of said exhaust gas recirculation passage. The downstream end of the downstream portion 16 of the exhaust gas recirculation passage is connected to a recirculated exhaust gas input port 6*a* which is provided at an intermediate part of the air intake passage 6, so that said recirculated exhaust gases which have flowed through said downstream portion 16 of the exhaust gas recirculation passage are injected into the air intake system of the engine 1, so as to provide the per se well known function of exhaust gas recirculation, as explained previously in this specification. There is located at an intermediate point along the exhaust gas recirculation passage, between the upstream portion 14 and the downstream portion 16 thereof, an exhaust gas recirculation control valve assembly generally designated by the reference numeral 12. This exhaust gas recirculation control valve assembly 12 controls the flow resistance of said exhaust gas recirculation passage, so as to control the above described flow of recirculated exhaust gases through the exhaust gas recirculation passage from the exhaust passage 10 to the air intake passage 6, according to the value of a vacuum signal supplied to said exhaust gas recirculation control valve assembly 12 as will be described later, so as to provide more or less exhaust gas recirculation for the diesel internal combustion engine 1, according to the operational conditions thereof.

Now the construction of this exhaust gas recirculation control valve assembly 12 will be explained. The exhaust gas recirculation control valve assembly 12 comprises an intake port 13 and an exhaust port 15. The intake port 13 is connected to the downstream end of the upstream portion 14 of the exhaust gas recirculation passage, and the exhaust port 15 is connected to the upstream end of the downstream portion 16 of the exhaust gas recirculation passage. The intake port 13 is formed with a valve seat 17, and the exhaust gas recirculation control valve assembly 12 further comprises a valve element 18 which cooperates with said valve seat 17 of said intake port 13, so that the flow resistance between the upstream portion 14 of the exhaust gas recirculation passage and the downstream portion 16 thereof is controlled by the amount by which said valve element 18 is displaced away from said valve seat 17 of said intake port 13, thereby determining the effective opening area of the hole through said intake port 13.

The valve element 18 is mounted on the left hand end in the figure of a valve rod 19, which can slidingly move in the left and right directions in the figure in the casing of the exhaust gas recirculation control valve assembly 12. The right hand end in the figure of this valve rod 19 is connected to the diaphragm 21 of a diaphragm actuator device 20. Within the body of the diaphragm actuator device 20, a diaphragm chamber 22 is defined to the right as seen in FIG. 1 of said diaphragm 21, and an atmospheric chamber **22*a* is defined to the left in the figure of said diaphragm 21, atmospheric air at atmospheric pressure being admitted to said atmospheric chamber 22*a* via a port 22*b*. The diaphragm 21 is biased in the leftwards direction in the figure by a compression coil spring 23 which is mounted within said diaphragm chamber 22 of said diaphragm actuator device 20, and on the other hand the diaphragm 21 is biased rightwards in the figure by the vacuum present within said diaphragm chamber 22, if any such vacuum is in fact present therein. I.e., the diaphragm 21 is biased rightwards in the figure by a distance depending on the difference between the current value of an atmospheric pressure which is present in the atmospheric chamber 22*a* and the vacuum present in the diaphragm chamber 22, if any. Accordingly, the greater is the value of the vacuum present in said diaphragm chamber 22 (i.e. the more is the depression of the pressure value therein below the current value of atmospheric pressure), the greater is the rightwards force on the diaphragm 21 in the figure which opposes the leftwards force exerted by said compression coil spring 23; and hence the more to the right as seen in the figure is the shifted position of said diaphragm 21 with the valve element 18 more removed from the valve seat 17 of the intake port 13, so that the greater is the amount of exhaust gas recirculation provided to the diesel internal combustion engine 1. On the other hand, the less is the value of the vacuum present in said diaphragm chamber (i.e. the less is the depression of the pressure value therein below the current value of atmospheric pressure), the less is the rightwards force on the diaphragm 21 in the figure which opposes the leftwards force exerted by said compression coil spring 23; and hence the more to the left as seen in the figure is the shifted position of said diaphragm 21 with the valve element 18 less removed from the valve seat 17 of the intake port 13, so that the less is the amount of exhaust gas recirculation provided to the diesel internal combustion engine 1. The actuating vacuum to the diaphragm chamber 22 is provided via a vacuum conduit 58** from a source which will be explained in detail in what follows.

A vacuum pump 32 is provided to said diesel internal combustion engine 1 and is driven from the crankshaft thereof by a belt or the like, so that the vacuum pump 32 is arranged to generate a continuous supply of vacuum whenever the diesel internal combustion engine 1 is running. This vacuum pump generates a supply of substantially constant vacuum of a fairly high vacuum value, i.e. fairly much depressed below atmospheric pressure. This vacuum thus generated by this vacuum pump 32 is fed via a vacuum conduit 33 to a brake vacuum servo unit of a per se well known sort not shown in the figures, and from this vacuum conduit 33 there branches off another vacuum conduit 24. Vacuum passes from this vacuum conduit 34 via, in the specified order: a vacuum restricting device 35 of a per se well known sort which applies a certain resistance to flow of air therethrough; another vacuum conduit 36; a port 38 of a temperature sensitive vacuum cutoff valve 37 which will be explained functionally with regard to its operation hereinafter; said temperature sensitive vacuum cutoff valve 37; another port 38 of said temperature sensitive cutoff valve 37; another vacuum conduit 40; a port 45 of an atmospheric pressure compensating valve 41 which will be explained in detail hereinafter both with regard to its structure and with regard to its function; said atmospheric pressure compensating valve 41; another port 46 of said atmospheric pressure compensating valve 41; another vacuum conduit 54; a port **70*a* of a vacuum control valve 55 which will also be explained in detail hereinafter both with regard to its structure and with regard to its function; said vacuum control valve 55; another port 71*a* of said vacuum control valve 55; a vacuum conduit 56; a port "a" of an electrically actuated two way switching valve 57 which is controlled by an electrical control device 100 according to the output signal of an engine revolution speed sensor 101, all of these devices being ones which will be explained functionally with regard to their operation hereinafter; said electrically actuated two way switching valve 57; another port "b" of said electrically actuated two way switching valve 57; and another vacuum conduit 58. From said vacuum conduit 58, this vacuum is introduced into said diaphragm chamber 22 of said diaphragm actuator device 20, so as to control the amount of exhaust gas recirculation provided to the diesel internal combustion engine 1** as explained above.

THE TEMPERATURE SENSITIVE VACUUM CUTOFF VALVE 37

Now, a functional explanation will be given of the temperature sensitive vacuum cutoff valve 37. This temperature sensitive vacuum cutoff valve 37 is a per se well known type of valve of either bimetallic or heat sensitive type, and responds to the temperature of the cooling water of the diesel internal combustion engine 1. When the temperature of the cooling water of the diesel internal combustion engine 1 is less than a certain predetermined temperature, then the port 38 of the temperature sensitive vacuum cutoff valve 37 is put out of communication with the port 39 thereof and said port 39 is communicated to the atmosphere and is supplied with air at atmospheric pressure; but, on the other hand, when the temperature of the cooling water of the diesel internal combustion engine 1 is higher than said certain predetermined temperature, then the port 38 of the temperature sensitive vacuum cutoff valve 37 is put into communication with the port 39 thereof, said port 39 being put out of communication with the atmosphere. This is in order to cut off exhaust gas recirculation to the diesel internal combustion engine 1 before said diesel internal combustion engine 1 has been fully warmed up, by, in these circumstances, supplying air at atmospheric pressure to the diaphragm chamber 22 of the diaphragm actuator 20, thus causing the compression coil spring 23 to forcingly bias the diaphragm 21 to its fully leftwardly displaced in the figure position, wherein via the valve rod 19 the valve element 18 is pushed against the valve seat 17 of the port 13 and interrupts flow of recirculated exhaust gases through said port 13 from the exhaust passage 10 to the intake passage 6.

THE ATMOSPHERIC PRESSURE COMPENSATING VALVE 41

Figure 2:
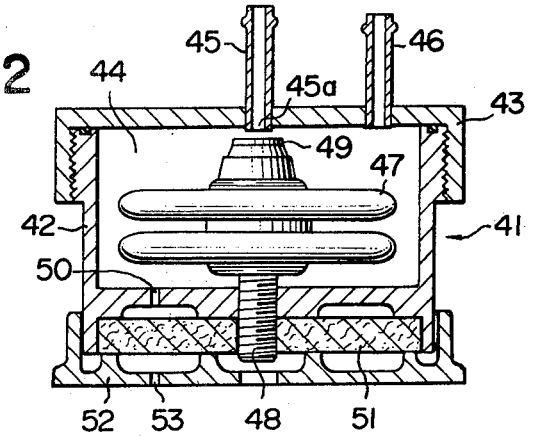
FIG. 2 is a partly axial sectional side view, showing the internal structure of an atmospheric pressure compensating valve incorporated in this first preferred embodiment of the diesel exhaust gas recirculation control system according to the present invention, said atmospheric pressure compensating valve being shown in a perspective view in FIG. 1.

In FIG. 2, there is shown in partly perspective partly axial sectional view the internal structure of the atmospheric pressure compensating valve 41, in this first preferred embodiment of the exhaust gas recirculation control system according to the present invention. The atmospheric pressure compensating valve 41 comprises a hollow casing 42, which is generally cylindrical in shape and the upper end in the figure of which is formed with a screwed portion on which is screwed an end cap 43. Thus, within the hollow casing 42 there is defined a pressure chamber 44. The port 45 which is communicated to the vacuum conduit 40, i.e. the intake port of this atmospheric pressure compensating valve 41 as far as the transmission of vacuum is concerned, opens through the end cap 43 to this pressure chamber 43 at the central point of the end cap 43 on the axis of the atmospheric pressure compensating valve 41, the opening end of a pipe which defines this port 45 being designated in FIG. 2 by the reference numeral 45*a;* and the port 45 which is communicated to the vacuum conduit 54, i.e. the output port of this atmospheric pressure compensating valve 41 as far as the transmission of vacuum is concerned, opens through the end cap 43 to this pressure chamber 43 at a point removed from the central axis of the atmospheric pressure compensating valve 41. The interior of the pressure chamber 44 is communicated to the atmosphere with a certain amount of flow resistance via a small hole 50 formed in the end of the hollow casing 42 remote from the end cap, via an air filter 51 incorporated in said end, and via another small hole 53 formed in a cover 52 which covers said air filter 51. Within the pressure chamber 44 there is provided an aneroid bellows 47, which is secured by a screw 48 thereon to the aforesaid end of the casing 42 remote from the end cap 43; and the tip end of this aneroid bellows 47 proximate to the opening end 45*a* of the port 45 is designated in the figure by the reference numeral 49.

This atmospheric pressure compensating valve operates as follows. When the absolute value of the pressure within the pressure chamber 44 is less than a certain predetermined value, said predetermined value depending upon the adjustment of the screw 48 and the distance from the tip end 49 of the aneroid bellows 47 to the opening end 45*a* of a port 45 in the relaxed condition of the aneroid bellows 47, then the aneroid bellows 47 expands to such a dexhaust gas recirculationee that its said tip end 49 is in contact with said opening end 45*a* of the port 45, and in this condition communication from the vacuum conduit 40 to the pressure chamber 44 is interrupted. Thus, quickly the atmospheric air entering the pressure chamber 44 through the small hole 53, through the air filter 51, and through the small hole 50 causes the absolute value of the pressure within the pressure chamber 44 to rise. On the other hand, when the absolute value of the pressure within the pressure chamber 44 is greater than said certain predetermined value, then the aneroid bellows 47 is contracted to a smaller size than its size in the abovementioned case, and thus its said tip end 49 comes out of contact with said opening end 45*a* of the port 45, and in this condition communication from the vacuum conduit 40 to the pressure chamber 44 is established. Thus, quickly the vacuum entering the pressure chamber 44 through the tip end 49 of the aneroid bellows 47 (faster than the air can enter through the small hole 50) causes the absolute value of the pressure within the pressure chamber 44 to drop. By the aternating combination of these two processes, therefore, the absolute value of the pressure within the pressure chamber 44 is caused to be maintained at a substantially constant pressure value, irrespective of the current value of atmospheric pressure; in the shown first preferred embodiment of the diesel exhaust gas recirculation system according to the present invention, this substantially constant pressure value is exemplarily taken as being about 340 mmHg absolute.

Figure 4:
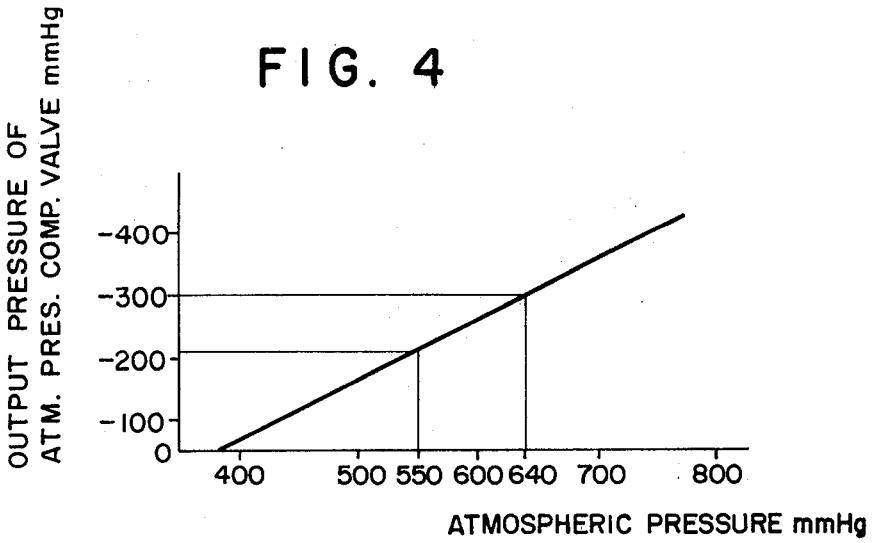
FIG. 4 is a graph, in which the absolute value of atmospheric pressure in mmHg is shown along the horizontal axis, and the amount by which the pressure in a pressure chamber of the atmospheric pressure compensating valve shown in detail in FIG. 2 is deviated from atmospheric pressure—i.e. in this case the vacuum valve present in said pressure chamber—is shown along the vertical axis.

FIG. 4 is a graph, in which the absolute value of atmospheric pressure in mmHg is shown along the horizontal axis and the amount by which the pressure in the pressure chamber 44 of the atmospheric pressure compensating valve 41 and outputted to the vacuum output port 46 is below atmospheric pressure, i.e. the vacuum value present in said pressure chamber 44 of the atmospheric pressure compensating valve 41 and outputted to the vacuum output port 46, is shown along the vertical axis. From this figure it will be understood that the output pressure from the atmospheric pressure compensating valve 41, i.e. the pressure present in the vacuum conduit 54, is substantially a constant value of 340 mmHg, in this particular exemplary case. In other words, the depression below the current value of atmospheric pressure which is present within the pressure chamber 44 of the atmospheric pressure compensating valve 41 and which is outputted to the vacuum output port 46 thereof increases steadily with atmospheric pressure with a slope of one. And in the shown exemplary case at standard atmospheric pressure of 760 mmHg the depression within the pressure chamber 44 is −420 mmHg, while, as shown in FIG. 4 by the exemplary horizontal and vertical lines drawn parallel to the abscissa and ordinate, at an atmospheric pressure of 640 mmHg the depression within the pressure chamber 44 is −300 mmHg (i.e. the absolute pressure therein is the constant value of 340 mmHg), while at an atmospheric pressure of 550 mmHg the depression within the pressure chamber 44 is −210 mmHg (i.e. the absolute pressure therein is still at the constant value of 340 mmHg).

THE VACUUM CONTROL VALVE 55

Figure 3:
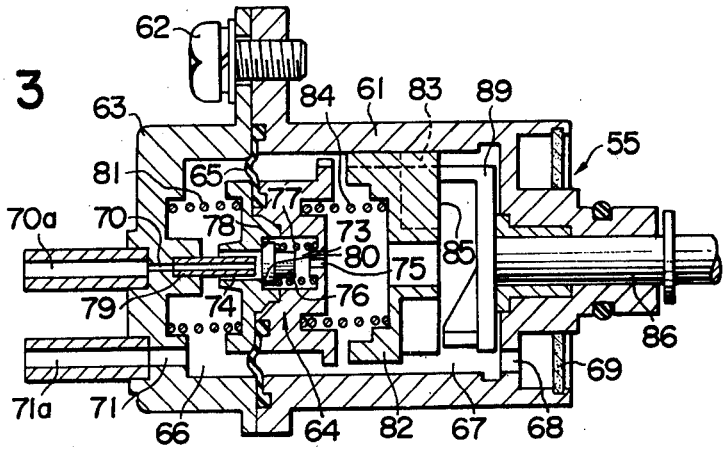
FIG. 3 is a partly perspective partly axial sectional view, showing the internal structure of a operating air pressure control valve incorporated in this first preferred embodiment of the diesel exhaust gas recirculation control system according to the present invention, said operating air pressure control valve being shown in a perspective view in FIG. 1.
Figure 7A:
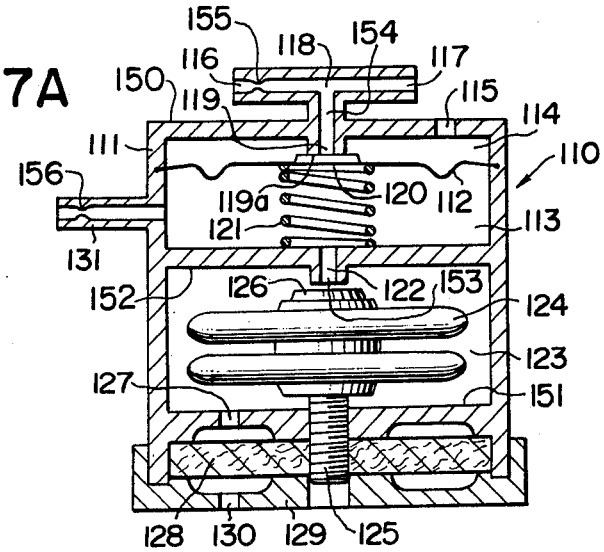
FIG. 7A is a partly axial sectional side view, similar to FIG. 2, showing the internal structure of a different form of atmospheric pressure compensating valve utilized in the second preferred embodiment of the diesel exhaust gas recirculation control system according to the present invention, said atmospheric pressure compensating valve being shown in FIG. 7.

FIG. 3 is a partly perspective partly axial sectional view, showing the internal structure of the vacuum control valve 55 incorporated in this first preferred embodiment of the diesel exhaust gas recirculation control system according to the present invention. This vacuum control valve 55 has a casing 61 which is formed generally as a hollow cylinder closed at one end, and to the open left hand end in the figure of this cylindrical casing 61 there is clamped by a plurality of bolts 62, only one of which can be seen in the figure, an end cap 63; and between the cylindrical casing 61 and the end cap 63 there is clamped the outer periphery of a diaphragm member 65, which is formed generally as an annulus surrounding a valve holder member 64 which will be described shortly. Thus, within the end cap 63 to the left in FIG. 3 of the diaphragm 65 and the valve holder member 64 there is defined a pressure chamber 66, and within the casing 61 to the right in FIG. 3 of the diaphragm 65 and the valve holder member 64 there is defined another chamber 67, which is an atmospheric pressure chamber, since it is communicated to the atmosphere via a hole 68 formed in the end of the hollow cylindrical casing 61 remote from the end cap 63, and via an air filter 69 incorporated in said end. The port 70*a* which is communicated to the vacuum conduit 54, i.e. the intake port of this vacuum control valve 55 as far as the transmission of vacuum is concerned, opens through the end cap 63 to a hole 70 which leads to this pressure chamber 66 at the central point of the end cap 63 on the axis of the vacuum control valve 55, the opening end of a pipe 79 being fixed into this hole 70, said pipe 79 extending into the pressure chamber 66 along its central axis for a certain distance and terminating therein; and the port 71*a* which is communicated to the vacuum conduit 56, i.e. the output port of this vacuum control valve 55 as far as the transmission of vacuum is concerned, opens through the end cap 63 to this pressure chamber 66 at a point removed from the central axis of the vacuum control valve 55.

The diaphragm 65 and the valve holder member 64 fixed thereon are biased in the rightwards direction in the figure by a compression coil spring 81 which is mounted within said diaphragm chamber 66 of the vacuum control valve 55, and on the other hand the diaphragm 65 and the valve holder member 64 fixed thereon are biased leftwards in the figure by the vacuum present within said diaphagm chamber 66, if any such vacuum is in fact present therein, to an amount which is proportional to the difference between the absolute value of said vacuum and the absolute value of atmospheric pressure, i.e. by an amount proportional to the depression below atmospheric pressure present within said diaphragm chamber 66. I.e., the diaphragm 21 is thus biased leftwards in the figure by a force which depends on the difference between the atmospheric pressure present in the atmospheric chamber 22*a* and the vacuum present in the diaphragm chamber 22, if any. Also the diaphragm 65 and the valve holder member 64 fixed thereon are biased in the leftwards direction in the figure by a compression coil spring 84 which is mounted within said atmospheric pressure chamber 67 of the vacuum control valve 55, the compression force of this compression coil spring 84 being arranged to be substantially less than the compression force of the compression coil spring 81, no matter where the diaphragm 65 and the valve holder member 64 mounted thereon may be axially located in the vacuum control valve 55, within their permissible and available amount of travel of course. The amount of this biasing force depends on the position of the right hand end in FIG. 3 of the compression coil spring 84, which is supported on a slidable spring mount 82. The spring mount 82 is slidable axially within the casing 61 of the vacuum control valve 55 to the left and the right in the drawing, engaging with antirotation guides 83 formed within the casing 61 which are not fully shown in the figure, and its axial position is determined as will be explained hereinafter.

The valve holder member 64 is formed as a cylinder with a valve cavity 73 inside it. This valve cavity 75 is communicated with the pressure chamber 66 on the left hand side in the figure of the valve holder member 64 by a hole 74, and is also communicated with the atmospheric chamber 67 on the right hand side in the figure of the valve holder member 64 by a hole 75. The compression coil springs 81 and 84 bear respectively on the left and the right hand ends of the valve holder member 64; in fact, on appropriately formed parts of said left and right hand ends. Within the valve cavity 73 there is received a valve element 76, which is biased in the leftwards direction in FIG. 3, so as to press against a valve seat 80 formed at the inner end of the hole 74 and so as to thereby close the hole 74, by a compression coil spring 77 which is also received within the valve cavity 73. The pipe 79 which is fixed into the hole 70 and which extends into the pressure chamber 66 enters into the hole 74 and opposes the outer surface of the valve element 76.

Accordingly, when the valve holder member 64 is in a position such as that shown in FIG. 3 wherein the end of this pipe 79 does not touch the valve element 76, then vacuum present in the vacuum conduit 54 is transmitted via the port 70*a* and the hole 70 and the pipe 79 to enter the pressure chamber 66, while the atmospheric pressure which is present as explained above in the atmospheric pressure chamber 67 is not transmitted through the hole 75 in the valve holder member 64, the valve cavity 73, and past the valve element 76 to enter into the hole 74 and thence to enter into the pressure chamber 66, because the valve element 76 is biased against the valve seat 80 by the compression coil spring 77. Accordingly, the absolute pressure value in the pressure chamber 66 decreases, assuming that the pressure in the vacuum conduit 54 is less than said pressure value in said pressure chamber 66. On the other hand, when the valve holder member 64 is in a position somewhat to the left in FIG. 3 of that shown in that figure, wherein the end of the pipe 79 presses against the valve element 76 and lifts the valve element 76 up from the valve seat 80, then vacuum present in the vacuum conduit 54 is not transmitted via the port 70*a* and the hole 70 and the pipe 79 to enter the pressure chamber 66, because the end of the pipe 79 is closed by being pressed against the valve element 76. But, on the other hand, the atmospheric pressure which is present as explained above in the atmospheric pressure chamber 67 is now transmitted through the hole 75 in the valve holder member 64 and passes through the valve cavity 73 and past the valve element 76 to enter into the hole 74 and thence to enter into the pressure chamber 66, because the valve element 76 is no longer biased against the valve seat 80 by the compression coil spring 77, but is lifted up therefrom by the pressing action of the end of the pipe 79, against the biasing action of the compression coil spring 77 which is overcome, said biasing action being of negligible value in comparison with the biasing actions of the compression coil springs 81 and 84. Accordingly, the absolute pressure value in the pressure chamber 66 increases. By a combination of these two actions, therefore, the absolute pressure value in the pressure chamber 66 of the vacuum control valve 55 is kept at a pressure value which is just sufficient to bias the diaphragm 65 and the valve holder member 64 fixed thereto, against the compression action of the compression coil spring 81 and with the help of the compression action of the compression coil spring 84 which is however substantially less as explained above, to a position which just brings the valve element 76 into contact with the open end of the pipe 79 within the hole 74, provided that sufficient vacuum exists within the vacuum conduit 54 to bring the pressure value in the pressure chamber 66 down to this value; if not, then the pressure value in the pressure chamber 66 is just equal to this pressure value within the vacuum conduit 54. In any case, the pressure value in the pressure chamber 66 is outputted to the vacuum conduit 56, via the hole 71 and the port 71*a*.

Now, this absolute pressure value in the pressure chamber 66 of the vacuum control valve 55 which is just sufficient to bias the diaphragm 65 and the valve holder member 64 fixed thereto, against the compression action of the compression coil spring 81 and with the help of the compression action of the compression coil spring 84, to a position which just brings the valve element 76 into contact with the open end of the pipe 79 within the hole 74 is just that pressure value the difference of which from the current value of atmospheric pressure is able to overcome the difference between the compression actions of the compression coil springs 81 and 84, when the diaphragm 65 and the valve holder member 64 fixed thereto are in the aforesaid axial position within the valve casing 61 of the vacuum control valve 55. Since the biasing action of the compression coil spring 81 when said compression coil spring 81 is compressed to the amount which occurs when the valve element 76 is just in contact with the open end of the pipe 79 is a constant force, thus, the depression below the current atmospheric pressure value which is regulated to be present in the pressure chamber 66 (assuming again that vacuum of sufficiently high vacuum value is actually available in the vacuum conduit 54) is determined by the compression force of the compression coil spring 84, which is determined by the axial position of its right hand end in the figure within the casing 61 of the vacuum control valve 55. Now, this right hand end of the compression coil spring 84 is, as mentioned above, supported on the spring mount 82 which is slidable axially within the casing 61 of the vacuum control valve 55 to the left and the right in the drawing, and accordingly the position of this spring mount 82 in the casing 61 determines the depression below the current atmospheric pressure value which is regulated to be present in the pressure chamber 66.

Now, in fact this spring mount 82 is thus moved according to the rotation of an end cam 89, which is fixed to a cam shaft 86 which is rotatably mounted along the axis of the vacuum control valve 55 and which extends out from the casing 61 thereof to the right in the figure. The end cam 89 presses against a cam follower portion 85 formed on the right hand surface in FIG. 3 of the spring mount 82. The cam shaft 86 is rotationally connected to the pump shaft 91 of the fuel injection pump 90 to which there is rotationally coupled the pump lever 92 which rotationally drives it. Accordingly, said cam shaft 86 and said end cam 89 are rotationally positioned according to the amount of depression of the accelerator pedal (not shown) of the vehicle incorporating the diesel internal combustion engine 1, i.e. according to the load on said diesel internal combustion engine 1.

The profile of the end cam 89 is not particularly shown in the figure, because it may be varied according to design and performance requirements for the dieesl internal combustion engine 1. In the shown first preferred embodiment of the exhaust gas recirculation control system according to the present invention, in fact, this end cam 89 is cut with a substantially flat first portion and then a substantially straight sloping remainder portion; and in line with this, as the pump lever shaft 91 turns smoothly from its position corresponding to zero load on the diesel internal combustion engine 1 to its position corresponding to full load on the internal combustion engine 1, for a certain first time period the spring mount 82 does not move to the left in FIG. 3 at all from its extreme position as positioned to the right in that figure, and subsequent to this first time period the spring mount 82 moves smoothly to the left. This means that the depression below the current atmospheric pressure value which is regulated to be present in the pressure chamber 66 (assuming still that vacuum of sufficiently high vacuum value is actually available in the vacuum conduit 54) is likewise controlled, so as to be first a substantially constant maximum value with increasing engine load during said first time period, and so as thenceforth smoothly to decrease with further increasing engine load. This performance of the depression below the current atmospheric pressure value which is regulated to be present in the pressure chamber 66 of the vacuum control valve 55 with respect to engine load is shown by the solid line in FIG. 5, which is a graph which shows the load on the diesel internal combustion engine 1 along the horizontal axis, and the depression below the current atmospheric pressure value which is regulated to be present in the pressure chamber 66 along the vertical axis. Herein it will be seen that the depression below the current atmospheric pressure value which is regulated to be present in the pressure chamber 66 as the engine load increased from zero up to a certain threshold value is about −370 mmHg, and that as the engine load increases thereafter past this certain threshold value this depression below the current atmospheric pressure value which is regulated to be present in the pressure chamber 66 smoothly decreases substantially proportionally to engine load. This is of course provided that sufficient vacuum actually exists in the vacuum conduit 54 to be thus regulated to provide this vacuum value in the pressure chamber 66 of the vacuum control valve 55; if such sufficient vacuum is not available in the vacuum conduit 54, then the vacuum value in the pressure chamber 66 will be just equal to that vacuum value in the vacuum conduit 54, since the open end of the pipe 79 will never come into contact with the valve member 78, and this valve member 78 will never be lifted from the valve seat 80.

THE SWITCHING VALVE 57

From the vacuum output port 71*a* of the vacuum control valve 55, vacuum is communicated to a first port designated as "a" of an electrically actuated two way switching valve 57, via the vacuum conduit 36. A second port designated as "b" of this electrically actuated two way switching valve 57 is communicated via the aforementioned vacuum conduit 58 to said diaphragm chamber 22 of said diaphragm actuator device 20, so as to supply said diaphragm device 20 with actuating vacuum, and a third port of this electrically actuated two way switching valve 57, designated as "c", is communicated via an air filter to the atmosphere and is thus always supplied with air at substantially atmospheric pressure.

This electrically actuated two way switching valve 57 is of a per se well known type, and includes (for example) a solenoid, and has three ports, designated as "a", "b", and "c" in the figure. When said solenoid is not supplied with actuating electrical energy, the ports "a" and "b" are communicated together while the port "c" is not communicated to any other port of said electrically actuated two way switching valve 57; but, on the other hand, when said solenoid is supplied with actuating electrical energy, the ports "b" and "c" are communicated together while the port "a" is not communicated to any other port of said electrically actuated two way switching valve 57. This solenoid of the electrically actuated two way switching valve 57 is selectively supplied with actuating electrical energy by the electrical control device 100 which will be described shortly with regard to its function.

Thus, as will be readily understood, provided that the electrically actuated two way switching valve 57 is not supplied with actuating electrical energy by the electrical control device 100, then its two ports "a" and "b" are kept communicated together while its port "c" is not communicated to any other port, and thus the aforementioned vacuum outputted from the vacuum control valve 55 and present in the vacuum conduit 56 is transmitted directly through said electrically actuated two way switching valve 57 to the diaphragm chamber 22 of the diaphragm actuator device 20 without being affected by said electrically actuated two way switching valve 57, thus causing said diaphragm actuator device 20 to be controlled according to the vacuum value of said vacuum, or rather according to the amount by which said vacuum is below atmospheric pressure. Thus, the greater is the vacuum outputted by the vacuum control device 55 and supplied to the diaphragm chamber 22, i.e. the more the pressure value of said vacuum is depressed below the current value of atmospheric pressure, the greater is the amount of effective opening of the hole through said intake port 13, and the greater is the amount of exhaust gas recirculation provided to the diesel internal combustion engine 1.

On the other hand, when the electrically actuated two way switching valve 57 is supplied with actuating electrical energy by the electrical control device 100, then its two ports "b" and "c" are communicated together while the port "a" is not communicated to any other port, and thus the aforementioned vacuum outputted from the vacuum control valve 55 and present in the vacuum conduit 56 is intercepted by the electrically actuated two way switching valve 57, and is not transmitted to the diaphragm chamber 22 of the diaphragm actuator device 20, which instead is supplied with air at substantially atmospheric pressure transmitted from the atmosphere through the air filter to the port "c" of the electrically actuated two way switching valve 57, through said electrically actuated two way switching valve 57, and through the conduit 58. Thus said diaphragm actuator device 20 is caused to be in the fully relaxed position, with its diaphragm 21 fully displaced in the leftwards direction as seen in the figure by the compression action of the compression coil spring 23, thus pressing the valve element 18 against the valve seat 17 of the intake port 13 by way of the valve rod 19 and intercepting fully the hole through said intake port 13, thus fully cutting off exhaust gas recirculation through the exhaust gas recirculation passage 14, and ensuring that no exhaust gas recirculation at all is available for the diesel internal combustion engine 1.

As stated earlier, the appropriate supply of actuating electrical energy to the electrically actuated two way switching valve 57, i.e. the supply of a steady electrical signal whose value is appropriately either high or low (that is, is either ON or OFF) to the electrically actuated two way switching valve 57, is made by the electrical control device 100, based upon the values of certain input signals which it receives. In the shown first preferred embodiment of the diesel exhaust gas recirculation control system according to the present invention (and in fact in the other two preferred embodiments which will be described, also) this electrical control device 100 inputs a signal from an engine revolution speed sensor 101 of a per se well known type, which senses the revolution speed of the crankshaft of the diesel internal combustion engine 1 and which outputs an electrical signal indicative of said revolution speed. No particular structure will be described for this electrical control device 100, because, based upon the description of the function thereof given herein, and based upon various forms of prior art exhaust gas recirculation electrical control device for various prior art exhaust gas recirculation control systems, various possible structures for such an electrical control device 100 can easily be conceived of by one of ordinary skill in the relevant art. For example, the electrical control device 100 might comprise a microcomputer with various programs stored in the memory thereof, and might further comprise various analog to digital and digital to analog converters of per se well known sorts which interface between the above described sensors and said microcomputer, and between said microcomputer and said electrically actuated ON/OFF switching valve 27 and said electrically actuated two way switching valve 57; and the details of the control programs for such a microcomputer will be easily conceived of by one of ordinary skill in the microprogramming art, based upon the functional disclosures relating to the overall control function of the electrical control device 100 contained in this specification. Alternatively, the electrical control device 100 might comprise various specialized electronic circuits for performing the functions explained herein and quite possibly other functions which are per se well known; and, again, the details of such specialized electronic circuits will be easily conceived of by one of ordinary skill in the art, based upon the functional disclosures in this specification.

In any case, the electrical control device 100 operates as follows, as it is comprised in the functioning of the shown preferred embodiment of the exhaust gas recirculation control system according to the present invention. When the revolution speed of the crankshaft of the diesel internal combustion engine 1, as sensed by the engine revolution speed sensor 101 and as transmitted therefrom to the electrical control device 100, is less than a first predetermined value, which may for example be 1200 to 1400 revolutions per minute, then the electrical control device 100 outputs an ON signal, i.e. a voltage high signal which causes, as explained above, the two ports "b" and "c" of the electrically actuated two way switching valve 57 to be communicated together while the port "a" is not communicated to any other port, and thus the aforementioned vacuum outputted from the vacuum control valve 55 and present in the vacuum conduit 56 is intercepted by the electrically actuated two way switching valve 57, and is not transmitted to the diaphragm chamber 22 of the diaphragm actuator device 20, which instead is supplied with air at substantially atmospheric pressure. Thus said diaphragm actuator device 20 is caused to be in the fully relaxed position, thus fully cutting off exhaust gas recirculation through the exhaust gas recirculation passage 14, and ensuring that no exhaust gas recirculation at all is available for the diesel internal combustion engine 1. Further, when the revolution speed of the crankshaft of the diesel internal combustion engine 1, as sensed by the engine revolution speed sensor 101 and as transmitted therefrom to the electrical control device 100, is greater than a second predetermined value, which may for example be 2700 to 2800 revolutions per minute, then the electrical control device 100 again outputs an ON signal, i.e. a voltage high signal which again causes, as explained above, the two ports "b" and "c" of the electrically actuated two way switching valve 57 to be communicated together while the port "a" is not communicated to any other port, and thus again the vacuum from the vacuum control valve 55 is not transmitted to the diaphragm chamber 22 of the diaphragm actuator device 20, which instead is supplied with air at substantially atmospheric pressure; and thus again said diaphragm actuator device 20 is caused to be in the fully relaxed position, thus again fully cutting off exhaust gas recirculation through the exhaust gas recirculation passage 14, and again ensuring that no exhaust gas recirculation at all is available for the diesel internal combustion engine 1. On the other hand, when the revolution speed of the crankshaft of the diesel internal combustion engine 1, as sensed by the engine revolution speed sensor 101 and as transmitted therefrom to the electrical control device 100, is greater than said first predetermined value and is less than said second predetermined value, i.e. is in between said first predetermined value and said second predetermined value, i.e. in the example is between about 1200 to about 1400 revolutions per minute and about 2700 to about 2800 revolutions per minute, then the electrical control device 100 outputs an OFF signal, i.e. a voltage low signal which causes, as explained above, the two ports "a" and "b" of the electrically actuated two way switching valve 57 are to be kept communicated together while its port "c" is not communicated to any other port, and thus the aforementioned vacuum outputted from the vacuum control valve 55 and present in the vacuum conduit 56 is transmitted directly through said electrically actuated two way switching valve 57 to the diaphragm chamber 22 of the diaphragm actuator device 20 without being affected by said electrically actuated two way switching valve 57, thus causing said diaphragm actuator device 20 to be controlled according to the vacuum value of said vacuum, or rather according to the amount by which said vacuum is below atmospheric pressure. Thus, in this case, the greater is the vacuum outputted by the vacuum control device 55 and supplied to the diaphragm chamber 22, i.e. the more the pressure value of said vacuum is depressed below the current value of atmospheric pressure, the greater is the amount of effective opening of the hole through said intake port 13, and the greater is the amount of exhaust gas recirculation provided to the diesel internal combustion engine 1.

OPERATION OF THE FIRST PREFERRED EMBODIMENT

The first preferred embodiment of the exhaust gas recirculation control system according to the present invention described above operates as follows.

When the temperature of the cooling water of the diesel internal combustion engine 1 is below said certain predetermined temperature, then the supply of vacuum produced by the vacuum pump 32 is intercepted at the temperature sensitive vacuum cutoff valve 37, whose port 39 is instead supplied with air at atmospheric pressure as explained above; and in this operational condition air at atmospheric pressure is supplied to the actuating chamber 22 of the diaphragm actuator device 20 of the exhaust gas recirculation control valve 12, and hence, as explained above, the diaphragm 21 thereof is biased by the compression coil spring 23 to its extreme leftwards position as seen in FIG. 1, in which the valve element 18 is pressed against the valve seat 17 formed on the port 13, and hence flow of exhaust gases through the exhaust gas recirculation conduit portions 14 and 16 is interrupted, and no exhaust gas recirculation is provided for the diesel internal combustion engine 1. This is in line with the above described requirement for not performing exhaust gas recirculation until the diesel internal combustion engine 1 has warmed up fully.

On the other hand, if on the contrary the temperature of the cooling water of the diesel internal combustion engine 1 is above said certain predetermined temperature, then the supply of vacuum produced by the vacuum pump 32 is not intercepted at the temperature sensitive vacuum cutoff valve 37, but is transmitted to the port 39 thereof. As explained above, if the revolution speed of the crankshaft of the diesel internal combustion engine 1 is not between the aforementioned first predetermined value and the aforementioned second predetermined value, i.e. is higher than the second predetermined value or is lower than the first predetermined value, then again any vacuum present in the vacuum conduit 56 will be intercepted by the two way electrically controlled vacuum switching valve 57 and will not be supplied to the vacuum conduit 58, which instead will be supplied with air at substantially atmospheric pressure; and in this case also, therefore, this air at atmospheric pressure is supplied to the actuating chamber 22 of the diaphragm actuator device 20 of the exhaust gas recirculation control valve 12, and hence, as before, the diaphragm 21 thereof is biased by the compression coil spring 23 to its extreme leftwards position as seen in FIG. 1, in which the valve element 18 is pressed against the valve seat 17 formed on the port 13, and hence flow of exhaust gases through the exhaust gas recirculation conduit portions 14 and 16 is interrupted, and again no exhaust gas recirculation is provided for the diesel internal combustion engine 1. This is in line with the also above described requirement for not performing exhaust gas recirculation when the revolution speed of the crankshaft of the diesel internal combustion engine 1 is higher than a certain value, or is lower than another certain value.

On the other hand, if the temperature of the cooling water of the diesel internal combustion engine 1 is above said certain predetermined temperature, and if also the revolution speed of the crankshaft of the diesel internal combustion engine 1 is between the aforementioned first predetermined value and the aforementioned second predetermined value, i.e. is higher than the first predetermined value and is also lower than the second predetermined value, then the temperature sensitive vacuum cutoff valve 37 and the two way electrically controlled vacuum switching valve 57 neither of them presents any substantial obstacle to the transmission of vacuum therethrough. Accordingly, the equilibrium vacuum value outputted by the vacuum control valve 55 is supplied to the actuating chamber 22 of the diaphragm actuator device 20 of the exhaust gas recirculation control valve 12, and hence the diaphragm 21 thereof is biased by the difference between this equilibrium vacuum value and the current value of atmospheric pressure, i.e. by the depression below atmospheric pressure of this equilibrium vacuum value in the actuating chamber 22, in the rightwards direction in FIG. 1, against the biasing action of the compression coil spring 23 which acts in the leftwards direction as seen in the figure, so as to position the valve element 18 to a distance away from the valve seat 17 formed on the port 13 which corresponds to the value of the depression below atmospheric pressure of said vacuum; and hence flow of exhaust gases through the exhaust gas recirculation conduit portions 14 and 16 is provided according to said depression amount, thus providing exhaust gas recirculation for the diesel internal combustion engine 1 according to the value of said vacuum depression amount, i.e. according to the amount of depression below atmospheric pressure of this vacuum value outputted by the vacuum control valve 55.

Now, the value of this amount of depression below atmospheric pressure of this equilibrium vacuum value outputted by the vacuum control valve 55, i.e. the amount of exhaust gas recirculation provided to the diesel internal combustion engine 1, is determined as follows, in this first preferred embodiment of the diesel exhaust gas recirculation control system according to the present invention. The atmospheric pressure compensating valve 41 is in this operational condition outputting a vacuum whose pressure value is substantially constant in absolute pressure value; in other words, the atmospheric pressure compensating valve 41 is outputting a vacuum whose depression below the current value of atmospheric pressure diminishes as atmospheric pressure diminishes, with a slope of unity in the case of this first preferred embodiment, as shown by the graph of FIG. 3. Now, the vacuum control valve 55, whatever may be the value of the vacuum supplied to its vacuum intake port 70*a*, is as explained above trying to output an equilibrium vacuum value through its output port 71*a* the value of the depression of which below atmospheric pressure corresponds to the current value of engine load according to the graph shown in FIG. 5 by the solid line. In this graph, the upper double dotted horizontal line represents the value of depression below the current value of atmospheric pressure of the output equilibrium vacuum value of the vacuum control valve 55 which when supplied to the diaphragm chamber 22 of the diaphragm actuator 20 will just cause the exhaust gas recirculation control valve assembly 12 to be fully open, i.e. to provide the maximum amount of exhaust gas recirculation to the diesel internal combustion engine 1; and the lower double dotted horizontal line represents the value of depression below the current value of atmospheric pressure of the output equilibrium vacuum value of the vacuum control valve 55 which when supplied to the diaphragm chamber 22 of the diaphragm actuator 20 will just cause the exhaust gas recirculation control valve assembly 12 to be fully closed, i.e. to provide the minimum amount (a zero amount) of exhaust gas recirculation to the diesel internal combustion engine 1. However, the vacuum control valve 55 of course cannot actually increase the value of the vacuum supplied to it at its vacuum intake port 70*a*; in other words, it is limited in its function of modulating vacuum by what is supplied to it. If therefore the amount of depression below current atmospheric pressure of the vacuum outputted by the atmospheric pressure compensating valve 41 is greater than the maximum value of the depression below current atmospheric pressure of the equilibrium vacuum pressure which the vacuum control valve 55 is trying to output (said maximum value of equilibrium vacuum pressure depression being outputted by the vacuum control valve 55, as explained above, when engine load is small), then no problem arises, and the amount of depression below current atmospheric pressure of the output equilibrium vacuum value of this vacuum control valve 55 varies with engine load according to the solid line in FIG. 5. If however the amount of depression below current atmospheric pressure of the vacuum outputted by the atmospheric pressure compensating valve 41 is in fact less than the maximum value of the amount of depression below current atmospheric pressure of the equilibrium vacuum pressure which the vacuum control valve 55 is trying to output (said maximum depression value of equilibrium vacuum pressure being outputted by the vacuum control valve 55, as explained above, when the current value of engine load is small), then the upper part of the solid line in FIG. 5 becomes chopped or sliced off, and the output amount of depression below current atmospheric pressure of the equilibrium vacuum value of this vacuum control valve 55 varies according to a line such as the dashed line in FIG. 5.

Figure 5:
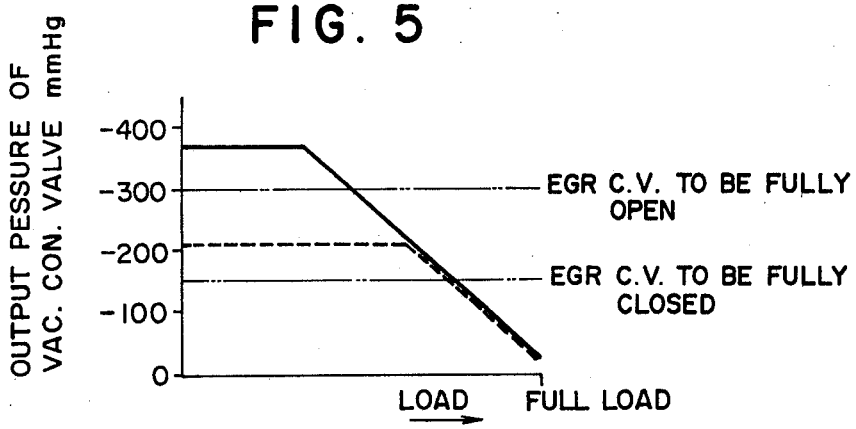
FIG. 5 is a graph which shows the load on the diesel internal combustion engine along the horizontal axis, and the deviation from the current atmospheric pressure value, i.e. vacuum value, which is regulated to be present in the pressure chamber of the operating air pressure control valve shown in detail in FIG. 3 along the vertical axis.

Now, concrete values will be taken by way of example. In FIG. 5 the solid line shows the performance of the amount of depression below current atmospheric pressure of the output vacuum produced by the vacuum control valve 55 in the event that said vacuum control valve 55 is supplied by the atmospheric pressure compensating valve 41 with input vacuum at its intake vacuum port 70*a* of a sufficiently high vacuum magnitude, i.e. of a sufficiently great depression below the current value of atmospheric pressure, fully to realize its regulatory function. It will be seen from the solid line in FIG. 5 that the vacuum control valve 55 in such circumstances outputs a vacuum value to the vacuum conduit 56 via the output port 71*a* the depression of which below the current value of atmospheric pressure is a maximum plateau value of about −370 mmHg when engine load is below a certain predetermined value of about 40%, and that as the value of the engine load increases steadily from said certain predetermined value of about 40% the depression below the current value of atmospheric pressure of the vacuum value output by the vacuum control valve 55 to the vacuum conduit 56 via the output port 71*a* steadily decreases so as to reach substantially zero at substantially full engine load. Further, according to the shown exemplary positions of the upper double dotted horizontal line and the lower double dotted horizontal line in FIG. 5, the value of depression below the current value of atmospheric pressure of the output equilibrium vacuum value of the vacuum control valve 55 which when supplied to the diaphragm chamber 22 of the diaphragm actuator 20 just causes the exhaust gas recirculation control valve assembly 12 to be fully open, i.e. to provide the maximum amount of exhaust gas recirculation to the diesel internal combustion engine 1, is about −300 mmHg; and the value of depression below the current value of atmospheric pressure of the output equilibrium vacuum value of the vacuum control valve 55 which when supplied to the diaphragm chamber 22 of the diaphragm actuator 20 just causes the exhaust gas recirculation control valve assembly 12 to be fully closed, i.e. to provide the minimum amount (a zero amount) of exhaust gas recirculation to the diesel internal combustion engine 1, is about −150 mmHg. Now, provided that the amount of depression below current atmospheric pressure of the vacuum outputted by the atmospheric pressure compensating valve 41 to the intake vacuum port 70*a* of the vacuum control valve 55 is greater than or equal to the maximum plateau value of −370 mmHg of the equilibrium vacuum depression which the vacuum control valve 55 is trying to output when engine load is below the abovementioned predetermined value of about 40%, which will be the case if the (substantially constant as explained above) absolute pressure value of 340 mmHg of this vacuum outputted by the atmospheric pressure compensating valve 41 provides a depression of greater than or equal to the maximum plateau value of −370 mmHg of the equilibrium vacuum depression which the vacuum control valve 55 is trying to output, i.e. if the current value of atmospheric pressure is greater than or equal to 710 mmHg, which is the case if the vehicle incorporating the diesel internal combustion engine 1 is being operated at or near sea level, then the performance of the vacuum control valve for outputting vacuum at its output port 71*a* and for controlling the exhaust gas recirculation control valve assembly 12 will be as shown by the solid line in FIG. 5; but, on the other hand, if the amount of depression below current atmospheric pressure of the vacuum outputted by the atmospheric pressure compensating valve 41 to the intake vacuum port 70*a* of the vacuum control valve 55 is less than the maximum plateau value of −370 mmHg of the equilibrium vacuum pressure which the vacuum control valve 55 is trying to output when engine load is below the abovementioned predetermined value of about 40%, which will be the case if the (substantially constant as explained above) absolute pressure value of 340 mmHg of this vacuum outputted by the atmospheric pressure compensating value 41 provides a depression of less than the maximum plateau value of −370 mmHg of the equilibrium vacuum depression which the vacuum control valve 55 is trying to output, i.e. if the current value of atmospheric pressure is less than 710 mmHg, which is the case if the vehicle incorporating the diesel internal combustion engine 1 is being operated at fairly high altitude, for example when said vacuum value outputted by the atmospheric pressure compensating valve 41 is equal to −210 mmHg as shown by the exemplary horizontal and vertical lines drawn parallel to the abscissa and ordinate in FIG. 4 which will occur when the current value of atmospheric pressure is 550 mmHg (so that the absolute pressure outputted by the atmospheric pressure compensating valve 41 is still equal to the constant value of 340 mmHg), the vehicle then being operated at quite high altitude, then the performance of the vacuum control valve 55 for outputting vacuum at its output vacuum port 71*a* and for controlling the exhaust gas recirculation control valve assembly 12 will be as shown by the dashed line in FIG. 5; in other words, the top of the plateau shown by the solid line in FIG. 5 will be sliced or chopped off, since as a matter of course the vacuum control valve 55 wil not be able to output a vacuum value whose depression below the current value of atmospheric pressure will be any more than the depression vacuum value of −210 mmHg with which said vacuum control valve 55 is supplied.

Figure 6:
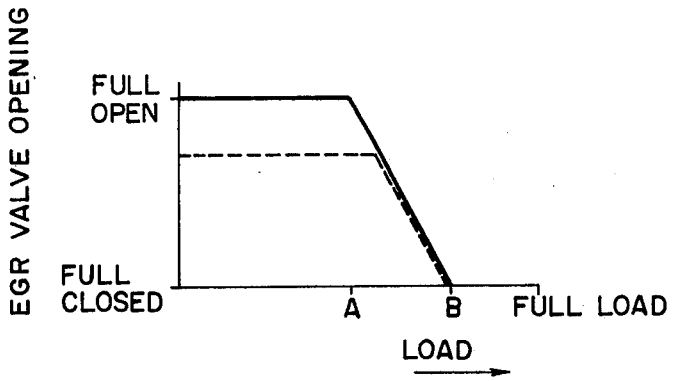
FIG. 6 is a graph corresponding to the portion of FIG. 5 contained between the double dashed lines, showing the load on the diesel internal combustion engine along the horizontal axis, and showing the amount of opening of the exhaust gas recirculation control valve assembly shown in FIG. 1 along the vertical axis.

Now, FIG. 6 is a graph corresponding to the portion of FIG. 5 contained between the double dashed lines, and in this figure the load on the diesel internal combustion engine is shown along the horizontal axis, and the amount of opening of the exhaust gas recirculation control valve assembly 12 is shown along the vertical axis. It should be noted that the position of the dashed line in this figure does not appear to correspond to the position of the dashed line in the part of the graph of FIG. 5 between the two double dashed horizontal lines, because the amount of opening of the exhaust gas recirculation valve assembly 12 is not directly proportional to the amount of depression below atmospheric pressure of the vacuum pressure supplied to the diaphragm chamber 22 thereof, although of course it increases smoothly and monotonically in accordance therewith. In this figure the solid line shows the performance of variation of the amount of opening of the exhaust gas recirculation control valve assembly 12 with respect to engine load, when the amount of depression below current atmospheric pressure of the vacuum outputted by the atmospheric pressure compensating valve 41 is greater at least than the depression below current atmospheric pressure (exemplarily shown as −300 mmHg) of the equilibrium vacuum pressure outputted by the vacuum control valve 55 to the diaphragm chamber 22 of the exhaust gas recirculation control valve 20 which is sufficient fully to open said exhaust gas recirculation valve assembly 12, so that in fact this output vacuum of the atmospheric pressure compensating valve 41 can be modulated to provide said output equilibrium vacuum value of this vacuum control valve 55 and to provide said vacuum value which can fully open said exhaust gas recirculation control valve assembly 12. This occurs when the value of engine load is less than a value "A" which is exemplarily equal to about 40%. On the other hand, when engine load attains a value "B", which is exemplarily equal to about 70%, then the exhaust gas recirculation control valve assembly 12 is fully closed. This of course will be the case if the current value of atmospheric pressure is greater than or equal to 640 mmHg, since in the shown first preferred embodiment of the diesel exhaust gas recirculation control system according to the present invention the absolute pressure value of the vacuum outputted by the atmospheric pressure compensating valve 41 is substantially constant and equal to 340 mmHg. If however the amount of depression below current atmospheric pressure of the vacuum outputted by the atmospheric pressure compensating valve 41 is in fact exemplarily as discussed above equal to −210 mmHg (i.e. if the current value of atmospheric pressure is equal to 500 mmHg), which is less than the value (exemplarily −300 mmHg) of the amount of depression below current atmospheric pressure of the equilibrium vacuum pressure outputted by the vacuum control valve 55 to the diaphragm chamber 22 of the exhaust gas recirculation control valve 20 which is sufficient fully to open said exhaust gas recirculation valve assembly 12, then in fact this output vacuum of the atmospheric pressure compensating valve 41 cannot be modulated to provide said output equilibrium vacuum value of this vacuum control valve 55 and to provide said vacuum value which can fully open said exhaust gas recirculation control valve assembly 12; and accordingly the upper part of the solid line in FIG. 5 becomes chopped or sliced off, and the exhaust gas recirculation valve assembly 12 is never fully opened, even when engine load is small, but even when engine load is small (less than a value "C" which is equal to about 55%) only opens to about 70% of its fully opened extent, so that in fact its opening performance with relation to engine load varies according to the dashed line in FIG. 6. On the other hand, when engine load attains a value "B", which is exemplarily equal to about 70%, then the exhaust gas recirculation control valve assembly 12 is fully closed, again.

Thus, in summary, with the shown first preferred embodiment of the diesel exhaust gas recirculation control system according to the present invention, when the vehicle incorporating said diesel exhaust gas recirculation control system is being operated at a high altitude where the atmospheric pressure is substantially diminished, above a certain threshold altitude (that altitude being the one, in the shown exemplary case, at which atmospheric pressure is equal to 640 mmHg), then the exhaust gas recirculation control valve assembly 12 is never fully opened, even in conditions of low vehicle load, but instead its maximum opening value in conditions when the engine load is less than a critical engine load value is reduced. In other words, as the altitude at which the vehicle is being operated increases and the atmospheric pressure accordingly diminishes, the amount of depression below the current value of atmospheric pressure of the atmospheric pressure compensated vacuum outputted by the atmospheric pressure compensating valve 41 decreases, and serves as a ceiling value for the amount of depression below the current value of atmospheric pressure of the control vacuum which is outputted by the vacuum control valve 55 and is used for operating the exhaust gas recirculation control valve assembly 12, bringing down the depression value of said control vacuum to its own depression value, if the depression of said control vacuum would otherwise be higher than said depression of said atmospheric pressure compensated vacuum. This ceiling effect has the effect of reducing the amount of exhaust gas recirculation provided by the exhaust gas recirculation control valve assembly 12 to the diesel internal combustion engine 1 in these circumstances, since the exhaust gas recirculation control valve assembly 12 is constituted, as explained above, so as to present a greater resistance to the flow of recirculated exhaust gases through the exhaust gas recirculation passage comprising the portions 14 and 16, the less is the depression of said control vacuum below the current value of atmospheric pressure. Since it will typically be the case that the target value for the depression below the current value of atmospheric pressure of the control vacuum outputted from the vacuum control valve 55 (i.e. the actual such depression, if a sufficient supply of input vacuum in the form of a sufficiently high atmospheric pressure compensated vacuum is available, which will be the case at a low altitude near sea level and at a consequent high value of atmospheric pressure) is high in conditions of low engine load and diminishes as the engine load increases—so as to give the per se well known function of large opening of the exhaust gas recirculation control valve assembly 12 in conditions of low engine load and of low opening of the exhaust gas recirculation control valve assembly in conditions of high engine load—thus in fact this ceiling effect of curtailing the maximum value of depression below the current value of atmospheric pressure of the control vacuum which is outputted by the vacuum control valve 55 and is used for operating the exhaust gas recirculation control valve assembly 12 when the atmospheric pressure is low, has the effect of providing less exhaust gas recirculation for the diesel internal combustion engine 1, when the value of the load on the diesel internal combustion engine 1 is low, at high altitude than at low altitude; and this altitude moderation effect on the quantity of exhaust gas recirculation is more pronounced, the higher is the altitude. Accordingly, proper compensation for changes in atmospheric pressure and operating altitude is provided; and the provision of a good and appropriate amount of exhaust gas recirculation for said diesel internal combustion engine 1 is assured, whatever may be the operating altitude of the vehicle incorporating said engine 1. Further, the exhaust gas recirculation control system whose structure and function are as described above does not run the risk of emitting undue smoke or soot from the diesel internal combustion engine 1, even during operation of the diesel internal combustion engine 1 at the low atmospheric pressure characteristic of high altitudes. Nor is the risk run of emitting undue noxious components in the exhaust gases of the diesel internal combustion engine 1, even during operation of the diesel internal combustion engine 1 at high altitude. Also, the diesel exhaust gas recirculation control system for a diesel internal combustion engine according to the present invention does not run the risk of poor drivability of the diesel internal combustion engine 1, even during such operation of the diesel internal combustion engine 1 at high altitude, because it properly modifies the amount of exhaust gas recirculation provided for the diesel internal combustion engine 1, according to the current value of engine load, in a fashion which is compensated for atmospheric pressure variations. This is made possible, according to the present invention, by an exhaust gas recirculation control system which is simple and which will be reliable in service, and which yet is cheap to manufacture. Accordingly the drivability of the diesel internal combustion engine 1 is advantageously promoted.

This result has been obtained by the provision of the atmospheric pressure compensating valve 41, whose output vacuum is depressed below the current value of atmospheric pressure by an amount which diminishes as the current value of atmospheric pressure diminishes. In fact, in the shown first preferred embodiment of the diesel exhaust gas recirculation control system according to the present invention, the amount by which the output vacuum of the atmospheric pressure compensating valve 41 is depressed below the current value of atmospheric pressure as the current value of atmospheric pressure diminishes diminishes by exactly the same amount as the atmospheric pressure diminishes: i.e. the absolute value of said output vacuum of the atmospheric pressure compensating valve 41 is substantially constant; but this is not to be considered as limitative of the present invention, but as a useful specialization thereof. The important concept of the present invention is that, as the current value of atmospheric pressure diminishes and corresponding thereto this amount by which the output vacuum of the atmospheric pressure compensating valve 41 is depressed below the current value of atmospheric pressure diminishes, at a certain threshold altitude the amount of depression of the output vacuum of the atmospheric pressure compensating valve 41 becomes insufficient fully to open the exhaust gas recirculation valve assembly 12, even when not at all modified by bleeding of air thereinto by the vacuum control valve 55; and thereby the exhaust gas recirculation valve assembly 12 is not fully opened even in conditions of low engine load, which as stated above provides proper compensation for changes in atmospheric pressure and operating altitude; and the provision of a good and appropriate amount of exhaust gas recirculation for said diesel internal combustion engine is thus assured, whatever may be the operating altitude of the vehicle incorporating said engine. Further, the exhaust gas recirculation control system whose structure and function are as described above does not run the risk of emitting undue smoke or soot from the diesel internal combustion engine, or of emitting undue noxious components in the exhaust gases thereof, even during operation at high altitude. Also, the diesel exhaust gas recirculation control system for a diesel internal combustion engine according to the present invention does not run the risk of poor drivability of the diesel internal combustion engine, even during such high altitude operation, because it properly modifies the amount of exhaust gas recirculation provided for the diesel internal combustion engine, according to the current value of engine load, in a fashion which is compensated for atmospheric pressure variations. Yet further, the proposed exhaust gas recirculation control system according to the present invention is simple and will be reliable in service, and yet is cheap to manufacture. Accordingly the drivability of the diesel internal combustion engine is advantageously promoted.

Further, of course, since the more the altitude of operation of the vehicle increases the lower becomes the current value of atmospheric pressure, thus the more insufficient the amount of depression of the output vacuum of the atmospheric pressure compensating valve 41 becomes fully to open the exhaust gas recirculation valve assembly 12, even when not modified by bleeding of air thereinto by the vacuum control valve 55; and thereby the exhaust gas recirculation valve assembly 12 is less and less fully opened even in conditions of low engine load. Since the abovementioned problems of emitting undue smoke or soot from the diesel internal combustion engine 1, during operation of the diesel internal combustion engine 1 at the low atmospheric pressure characteristic of high altitudes, of emitting undue noxious components in the exhaust gases, and of poor drivability of the vehicle incorporating the diesel internal combustion engine, become as a matter of course more aggravated the higher is the altitude of operation of the vehicle and the lower becomes the current value of atmospheric pressure, this is very advantageous in order to properly modify the amount of exhaust gas recirculation provided for the diesel internal combustion engine, according to the current value of engine load, in a fashion which is compensated for atmospheric pressure variations, and thus advantageously to promote the drivability of the diesel internal combustion engine.

As a further specialized feature of the present invention, and as another benefit obtained thereby, it should be noted that at an elevated altitude not only does the maximum amount of opening of the exhaust gas recirculation control valve assembly 12 becomes reduced from 100% to a lower value which further diminishes as altitude increases, but also the critical value of engine load below which the exhaust gas recirculation control valve assembly 12 is kept at said maximum amount of opening increases, so that the behavior of opening amount of the exhaust gas recirculation valve assembly 12 with respect to engine load remains the same in the higher regions of engine load at which said maximum amount of opening of the exhaust gas recirculation control valve assembly 12 is not provided. In other words, referring to the graph of FIG. 6, the horizontal coordinate of the corner in the performance line moves from point A in the case of the solid line to point C in the case of the dashed line. This has the good advantages that above said critical value of engine load the exhaust gas recirculation control valve assembly 12 is caused to provide the same performance of opening the exhaust gas recirculation passage as at sea level, which is proper and appropriate, but that this critical value is more increased, the lower is the current value of atmospheric pressure, thus keeping the range of engine load during which the amount of exhaust gas recirculation is reduced the larger, the lower is the current value of atmospheric pressure.

Figure 7:
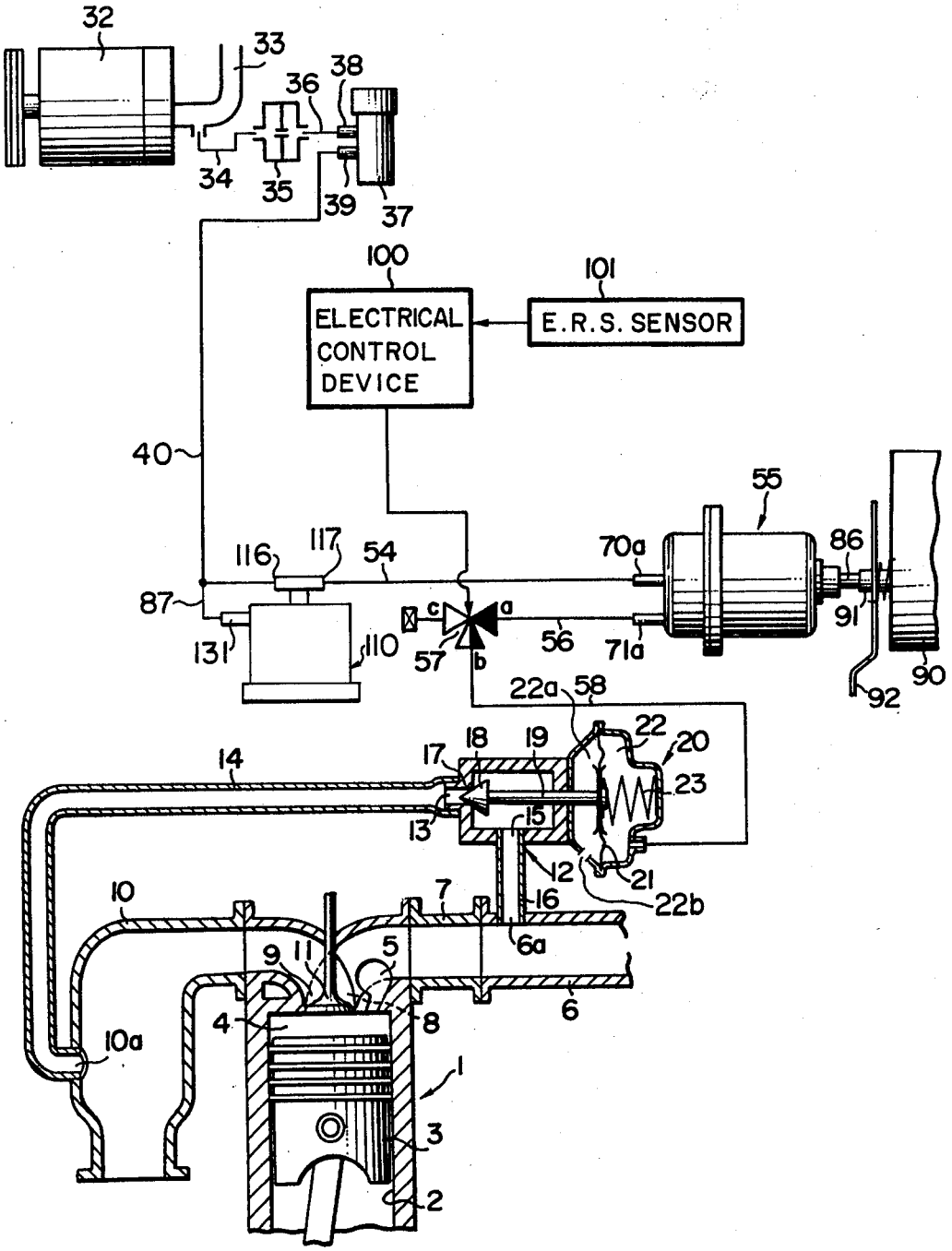
FIG. 7 is a partly schematic partly cross sectional view, similar to FIG. 1 for the first preferred embodiment, showing the essential parts of a second preferred embodiment of the diesel exhaust gas recirculation control system according to the present invention, said second preferred embodiment utilizing a different form of atmospheric pressure compensating valve from that used in the first embodiment shown in FIGS. 1 and 2, this figure also showing relevant parts of a diesel internal combustion engine of a per se well known sort the exhaust gas recirculation of which is being controlled by this second preferred embodiment.

In FIGS. 7 and *7a*, there is shown a second preferred embodiment of the diesel exhaust gas recirculation control system according to the present invention, in a fashion similar to FIG. 1 and FIG. 2, respectively. In FIGS. 7 and *7a*, parts, passages, and chambers of the second preferred embodiment shown, which correspond to parts, passages, and chambers of the first preferred embodiment shown in FIGS. 1 and 2, and which have the same functions, are designated by the same reference numerals and symbols as in those figures.

As may be understood from FIG. 7, which is a partly schematic partly cross sectional view, showing the essential parts of the second preferred embodiment of the diesel exhaust gas recirculation control system according to the present invention, and also showing relevant parts of a diesel internal combustion engine 1 of a per se well known sort the exhaust gas recirculation of which is being controlled thereby, the only way in which the construction of this second preferred embodiment differs from the construction of the first preferred embodiment shown in FIGS. 1 through 3 is that the atmospheric pressure compensating valve is different, and the connecting vacuum line arrangement thereto is also different. This atmospheric pressure compensating valve of the second preferred embodiment, denoted by the reference numeral 110 in the figures, is shown in detail in part axial section part perspective view in FIG. *7a*.

Now referring to this FIG. *7a*, this atmospheric pressure compensating valve 110 comprises a hollow casing 111, which is generally cylindrical in shape, the upper part in the figure of which is formed as an upper end 150, and the lower part in the figure of which is formed as a lower end 151. Within the hollow casing 111 there is defined in order from the top to the bottom of the drawing a first atmospheric pressure chamber 114, a pressure chamber 113, and a second atmospheric pressure chamber 123. The first atmospheric pressure chamber 114 is communicated substantially freely to the atmosphere through an opening 115 pierced through the upper end 150 of the casing 111, and the second atmospheric pressure chamber 114 is communicated substantially freely to the atmosphere through an opening 117 pierced through the lower end 151 of the casing 111, through an air filter 128, and through another opening 130 pierced through a filter cover 129 fitted over the air filter 128. Between the first atmospheric pressure chamber 114 and the pressure chamber 113 there is provided a diaphragm 112 which separates them, and between the pressure chamber 113 and the second atmospheric pressure chamber 123 there is provided a wall 152, which separates them except that a hole 122 is pierced through this wall 152, the end of the hole 122 which extends into the second atmospheric pressure chamber 123 being formed as a valve port 153. The atmospheric pressure compensating valve 110 is provided with a port 116 which is an intake port as far as the transmission of vacuum is concerned and a port 117 which is an output port as far as the transmission of vacuum is concerned, which are communicated together by a passage 118 to an intermediate portion of which a port passage 154 opens. The port passage 154 opens to the first atmospheric pressure chamber 114, and the end of the port passage 154 which extends into the first atmospheric pressure chamber 114 is formed as a valve port 119. The part of the vacuum intake port 116 which leads to the port passage 154 is formed as a constrictor element 155. A control port 131 opens to the pressure chamber 113, and as seen in FIG. 7 in fact this control port 131 is communicated to the same source of vacuum as is the vacuum intake port 116. The part of the control port 131 which leads to the pressure chamber 113 is formed as a constrictor element 156. On the diaphragm 112 there is mounted, as opposing the valve port 119, a valve element 120, which therefore, according to its distance from said valve port 119, controls the effective flow resistance to passage of gas between the first atmospheric pressure chamber 114 and the port passage 154. The combination of the diaphragm 112 and the valve element 120 fixed thereon are biased in the upwards direction in FIG. *7a*, i.e. in the direction to reduce the volume of the first atmospheric pressure chamber 114 and to increase the volume of the pressure chamber 113, by a compression coil spring 121. Within the second atmospheric pressure chamber 123 there is provided an aneroid bellows 124, which is secured by a screw 125 thereon to the aforesaid lower end 151 of the casing 111; and the tip end of this aneroid bellows 124 proximate to the valve port 153 is designated in the figure by the reference numeral 126. This tip portion 126 of the aneroid bellows 124, therefore, according to its distance from said valve port 153, controls the effective flow resistance to passage of gas between the pressure chamber 113 and the second atmospheric pressure chamber 123.

This atmospheric pressure compensating valve 110 operates as follows. As will be understood from FIG. 7, the vacuum from the vacuum output port 39 of the temperature sensitive vacuum cutoff valve 37 is supplied via the vacuum conduit 40 to the vacuum input port 116 of the atmospheric pressure compensating valve 110, and is also supplied via a vacuum conduit 87 which branches off from an intermediate part of said vacuum conduit 40 to the control port 131 of the atmospheric pressure compensating valve 110. The pressure value within the second atmospheric pressure chamber 123 is of course substantially equal to atmospheric, and accordingly the dimension of the aneroid bellows 124 in the axial direction is determined by the current absolute value of atmospheric pressure, being the less, the greater is the current absolute value of atmospheric pressure. Therefore the distance between the tip end portion 126 of the aneroid bellows 124 and the valve port 153 is determined by the current absolute value of atmospheric pressure, being the greater the greater is the current absolute value of atmospheric pressure, and of course also being determined by the distance from the tip end 126 of the aneroid bellows 124 to the port 153 in the relaxed condition of the aneroid bellows 124; and accordingly the flow resistance to passage of air between the pressure chamber 113 and the second atmospheric pressure chamber 123 is also determined by the current absolute value of atmospheric pressure, being the less, the greater is the current absolute value of atmospheric pressure. Now, the amount of depression below the current value of atmospheric pressure of the vacuum pressure within the pressure chamber 113 is determined by the ratio between the resistance of the constrictor element 156 and the flow resistance to passage of air between the pressure chamber 113 and the second atmospheric pressure chamber 123, and therefore is the less, the greater is the current absolute value of atmospheric pressure. The diaphragm 112 and the valve element 210 fixedly mounted thereon are impelled upwards in the figure by the action of the compression coil spring 121 which is the greater the more that compression coil spring 121 is compressed, and is impelled downwards in the figure, in the direction away from the valve port 119 so as to reduce the volume of the pressure chamber 113 and to increase the volume of the first atmospheric pressure chamber 114, by the difference between the current value of atmospheric pressure which is present in said first atmospheric pressure chamber 114 and the amount of depression below the current value of atmospheric pressure of the vacuum pressure within the pressure chamber 113; and accordingly the distance between the valve element 120 and the valve port 119 is determined by the amount of depression below the current value of atmospheric pressure of the vacuum pressure within the pressure chamber 113, being the greater, the greater is said amount of depression below the current value of atmospheric pressure of the vacuum pressure within the pressure chamber 113. Accordingly, the flow resistance to passage of air between the passage 118 and the first atmospheric pressure chamber 114 is determined by the amount of depression below the current value of atmospheric pressure of the vacuum pressure within the pressure chamber 113, being the less, the greater is said amount of depression below the current value of atmospheric pressure of the vacuum pressure within the pressure chamber 113, and accordingly being the greater, the greater is the current absolute value of atmospheric pressure. Now, the amount of depression below the current value of atmospheric pressure of the vacuum pressure within the passage 118 is determined by the ratio between the resistance of the constrictor element 116 and the flow resistance to passage of air between the passage 118 and the first atmospheric pressure chamber 114, and therefore is the greater, the greater is the current absolute value of atmospheric pressure. This pressure in the passage 118 is supplied as its output vacuum pressure by the atmospheric pressure compensating valve 110, to the vacuum conduit 54, as in the case of the previous embodiment, as may be seen from FIG. 7.

Accordingly it is seen that the output pressure of the atmospheric pressure compensating valve 110, as in the previously described first preferred embodiment, depends upon the current value of atmospheric pressure, and is the greater, the greater is the current absolute value of atmospheric pressure. In fact, if the characteristics of the various parts of this atmospheric pressure compensating valve 110 are so selected, it will be the case, as in said previously described first preferred embodiment, that the absolute value of the output pressure of the atmospheric pressure compensating valve 110 may be caused to be maintained at a substantially constant pressure value, irrespective of the current value of atmospheric pressure, although this is not a necessary feature of the second preferred embodiment, but is a particular possibility thereof; and in this exemplary case, as in the shown first preferred embodiment of the diesel exhaust gas recirculation system according to the present invention, this substantially constant pressure value may exemplarily be about 340 mmmHg absolute. In this case, the graph of FIG. 4 is also applicable to this case also. In other words, the depression below the current value of atmospheric pressure which is present within the passage 18 of the atmospheric pressure compensating valve 110 and which is outputted to the vacuum output port 46 thereof, in this case, increases steadily with atmospheric pressure with a slope of one. Thus, in this exemplary case, at standard atmospheric pressure of 760 mmHg the depression below the current value of atmospheric pressure of the of the atmospheric pressure compensating valve 110 is −420 mmHg. Thus, it will be easily understood that the same beneficial results as were obtained in the case of the previously described first embodiment are obtained.

Figure 8:
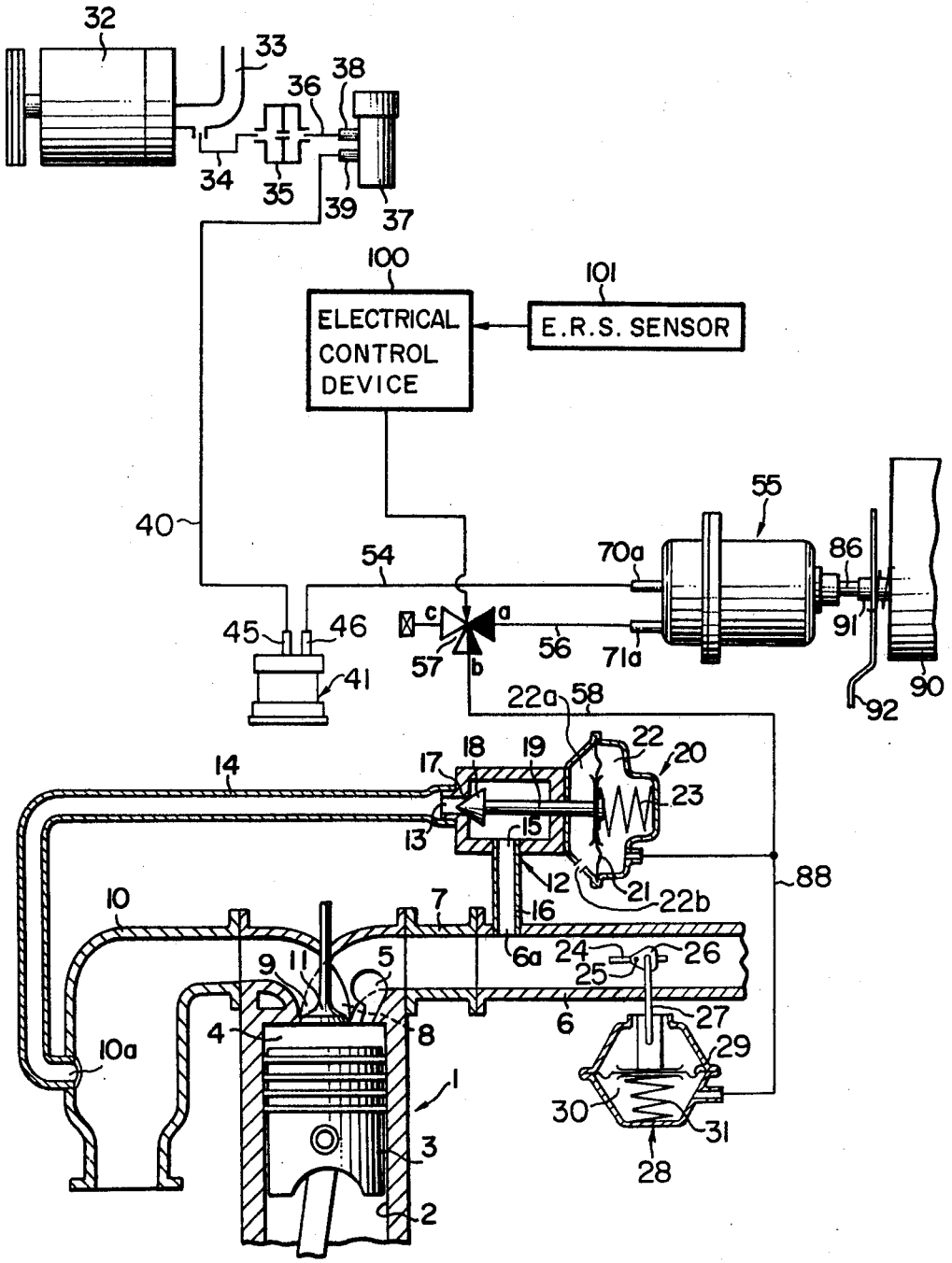
FIG. 8 is a partly schematic partly cross sectional view, similar to FIGS. 1 and 2, showing the essential parts of a third preferred embodiment of the diesel exhaust gas recirculation control system according to the present invention, said third preferred embodiment utilizing the same form of atmospheric pressure compensating valve as the first embodiment shown in FIGS. 1 and 2, but including an intake passage throttling butterfly valve and an actuator therefor, this figure also showing relevant parts of a diesel internal combustion engine of a per se well known sort the exhaust gas recirculation of which is being controlled by this third preferred embodiment.

In FIG. 8, there is shown a third preferred embodiment of the diesel exhaust gas recirculation control system according to the present invention, in a fashion similar to FIG. 1 and FIG. 7. In FIG. 8, parts, passages, and chambers of the third preferred embodiment shown, which correspond to parts, passages, and chambers of the first and second preferred embodiments shown in FIG. 1 and in FIG. 7, and which have the same functions, are designated by the same reference numerals and symbols as in those figures.

As may be understood from FIG. 8, which is a partly schematic partly cross sectional view, showing the essential parts of the third preferred embodiment of the diesel exhaust gas recirculation control system according to the present invention, and also showing relevant parts of a diesel internal combustion engine 1 of a per se well known sort the exhaust gas recirculation of which is being controlled thereby, the only way in which the construction of this third preferred embodiment differs from the construction of the first preferred embodiment shown in FIGS. 1 through 3 is that this third preferred embodiment further includes an intake passage throttling butterfly valve and an actuator therefor.

The intake passage butterfly valve is designated by the reference numeral 24 in the figure, and is located within the intake passage 6 of the diesel internal combustion engine 1, upstream of the aforementioned intermediate part of the air intake passage 6 at which the recirculated exhaust gas input port 6*a* to which the downstream end of the downstream portion 16 of the exhaust gas recirculation passage is connected is provided. This butterfly valve 24 is pivoted within the air intake passage 6 about a rotational axis 25, and is rotationally coupled to a drive lever 26. The upper end in the figure of an actuating rod 27 is coupled to this drive lever 26, and the lower end in the figure of this actuating rod 27 is drivingly connected to the diaphragm 29 of a diaphragm actuator 28 for the butterfly valve 24. A diaphragm chamber 30 is defined below the diaphragm 29 in the figure, and this diaphragm chamber 30 is provided via a vacuum conduit 88 with the vacuum present in the vacuum conduit 58, i.e. with the same vacuum (the output vacuum of the vacuum control valve 55) which drives the diaphragm actuator 20 of the exhaust gas recirculation control valve assembly 12. In the diaphragm chamber 30 there is provided a compression coil spring 31, which biases said diaphragm 29 and said actuating rod 27 upwards in the figure so as to bias the butterfly valve 24 in the counterclockwise direction as seen in the figure against a stop member, not shown, which prevents said butterfly valve 24 moving in the counterclockwise direction past its position as seen in the figure, i.e. the position of said butterfly valve 24 in which it provides minimum resistance to flow of intake air in the air intake passage 6. The chamber defined within the diaphragm actuator 28 on the other side of the diaphragm 29 is open to the atmosphere, and thus, the greater is the value of the depression below the current value of atmospheric pressure of the vacuum present within the vacuum conduits 58 and 88 and within the diaphragm chamber 30, the more is the diaphragm 29 depressed from the point of view in the figure, the more is the butterfly valve 24 rotated in the clockwise direction as seen in the figure, and the greater is the choking resistance which said butterfly valve 24 provides to flow of intake air of the diesel internal combustion engine 1 through the air intake passage 6.

Thus, in the case of this third preferred embodiment of the exhaust gas recirculation control system according to the present invention, the operation of the exhaust gas recirculation control valve assembly 12 is synchronized with the operation of this intake passage choke butterfly valve 24. Further, according to this structure, this intake passage choke butterfly valve 24 is operated by the same control vacuum as is used for operating the exhaust gas recirculation control valve assembly 12. Accordingly, the ceiling effect of curtailing the maximum value of depression below the current value of atmospheric pressure of the control vacuum which is outputted by the vacum control valve 55 when the atmospheric pressure is low also has the effect of providing less intake passage throttling for the diesel internal combustion engine 1, when the value of the load on the diesel internal combustion engine 1 is low, at high altitude than at low altitude; and this altitude moderation effect on the quantity of intake passage throttling is also more pronounced, the higher is the altitude. This effect of moderating the amount of intake passage throttling according to the altitude operates synergistically with the effect of moderating the amount of exhaust gas recirculation provided through the exhaust gas recirculation passage according to the altitude, to further provide proper compensation for changes in atmospheric pressure and operating altitude; and the provision of a good and appropriate amount of exhaust gas recirculation for said diesel internal combustion engine 1 is thus further assured, whatever may be the operating altitude of the vehicle incorporating said engine 1. Further, by such additional intake passage choking, the exhaust gas recirculation control system whose structure and function are as described above is further guarded from the risk of emitting undue smoke or soot, or of emitting undue noxious components in the exhaust gases of the diesel internal combustion engine 1, even during operation of the diesel internal combustion engine 1 at high altitude. Also, by such additional intake passage choking, the diesel exhaust gas recirculation control system for a diesel internal combustion engine according to the present invention further ensures good drivability of the diesel internal combustion engine, even during such operation of the diesel internal combustion engine at high altitude, because it further properly modifies the amount of exhaust gas recirculation provided for the diesel internal combustion engine, by such intake passage choking which helps to suck a larger amount of exhaust gases through the exhaust gas recirculation passage, according to the current value of engine load, in a fashion which is compensated for atmospheric pressure variations. Accordingly the drivability of the diesel internal combustion engine 1 is further advantageously promoted.

Although the present invention has been shown and described with reference to several preferred embodiments thereof, and in terms of the illustrative drawings, it should not be considered as limited thereby. Various possible modifications, omissions, and alterations could be conceived of by one skilled in the art to the form and the content of any particular embodiment, without departing from the scope of the present invention. Therefore it is desired that the scope of the present invention, and of the protection sought to be granted by Letters Patent, should be defined not by any of the perhaps purely fortuitous details of the shown embodiments, or of the drawings, but solely by the scope of the appended claims, which follow.

What is claimed is:

1. For a diesel internal combustion engine for a vehicle, comprising an air intake passage, an exhaust passage, and an exhaust gas recirculation passage whose upstream end is communicated to an intermediate point of said exhaust passage and whose downstream end is communicated to an intermediate point of said air intake passage:

an exhaust gas recirculation control system, comprising:

(a) a source of operating air pressure;

(b) an atmospheric pressure compensation valve, comprising an operating air pressure intake port and an operating air pressure output port, which receives a supply of said operating air pressure at its said operating air pressure intake port, and selectively bleeds atmospheric air into said supply of intake operating air pressure so as to produce a supply of atmospheric pressure compensated operating air pressure at its said operating air pressure output port, the amount by which the pressure value of said atmospheric pressure compensated output operating air pressure is deviated from the current value of atmospheric pressure diminishing as the absolute value of atmospheric pressure diminishes;

(c) an operating air pressure control valve, comprising an operating air pressure intake port and an operating air pressure output port, which receives a supply of said atmospheric pressure compensated operating air pressure from said operating air pressure output port of said atmospheric pressure compensation valve at its said operating air pressure intake port, and which selectively bleeds atmospheric air into said supply of atmospheric pressure compensated operating air pressure according to the value of the load on said diesel internal combustion engine so as to produce a supply of control operating air pressure at its said operating air pressure output port; the deviation from the current value of atmospheric pressure of said control operating air pressure either being equal to a target depression value which is determined according to said load on said diesel internal combustion engine, or being equal to the deviation value of said supply of atmospheric pressure compensated operating air pressure from said operating air pressure output port of said atmospheric pressure compensation valve, whichever is the less;

and (d) an operating air pressure operated exhaust gas recirculation control valve comprising an operating air pressure intake port, which receives a supply of said control operating air pressure from said operating air pressure output port of said operating air pressure control valve at its said operating air pressure intake port, and which controls the flow resistance of said exhaust gas recirculation passage according to the difference between the current value of atmospheric pressure and the current pressure value of said control operating air pressure supplied to its said operating air pressure intake port, so as to decrease said flow resistance from a maximum substantially infinite value such as to allow exhaust gas recirculation when the deviation from the current value of atmospheric pressure of said control operating air pressure increases beyond a certain predetermined value.

2. An exhaust gas recirculation control system according to claim 1, wherein the amount by which said atmospheric pressure compensated output operating air pressure of said atmospheric pressure compensation valve is deviated from the current value of atmospheric pressure diminishes steadily as the absolute value of atmospheric pressure diminishes.

3. An exhaust gas recirculation control system according to claim 1, wherein the amount by which said atmospheric pressure compensated output operating air pressure of said atmospheric pressure compensation valve is deviated from the current value of atmospheric pressure diminishes steadily as the absolute value of atmospheric pressure diminishes.

4. An exhaust gas recirculation control system according to claim 1, further comprising:

(e) an operating air pressure operated intake passage choking valve comprising an operating air pressure intake port, which receives a supply of said control operating air pressure from said operating air pressure output port of said operating air pressure control valve at its said operating air pressure intake port, and which controls the flow resistance of said air intake passage at a point therein upstream of said intermediate point thereof to which said air intake passage is communicated according to the difference between the current value of atmospheric pressure and said control operating air pressure supplied to its said operating air pressure intake port, so as to increase said flow resistance value as the deviation from the current value of atmospheric pressure of said control operating air pressure increases.

5. An exhaust gas recirculation control system according to any one of claims 1 through 4, wherein said atmospheric pressure compensation valve comprises a casing formed with an interior cavity, a control valve port opening into said interior cavity, an aneroid bellows within said interior cavity one end of which is fixed to said casing while the other end confronts said control valve port and controls its opening and closing, and a means for admitting atmospheric air into said interior cavity with a substantial amount of flow resistance being provided to said admission; said operating air pressure intake port of said atmospheric pressure compensation valve being communicated to said control valve port, while said operating air pressure output port of said atmospheric pressure compensation valve is communicated to said interior cavity.

6. An exhaust gas recirculation control system according to any one of claims 1 through 4, wherein said atmospheric pressure compensation valve comprises: a casing formed with a first interior cavity and a second interior cavity; a diaphragm which separates said second interior cavity into an operating air pressure chamber and an atmospheric pressure chamber; a first control valve port which communicates said operating air pressure chamber with said first interior cavity; a second control valve port opening into said atmospheric pressure chamber; a first passage leading from said atmospheric pressure chamber to the atmosphere with substantially no flow resistance being interposed between said atmospheric pressure chamber and the atmosphere; a second passage leading from said first chamber to the atmosphere with substantially no flow resistance being interposed between said first chamber and the atmosphere; an aneroid bellows within said first chamber one end of which is fixed to said casing while the other end confronts said first control valve port and controls its amount of opening; a valve element fixed to said diaphragm which confronts said second control valve port and controls its amount of opening; a means for biasing said diaphragm and said valve element in their directions to increase the size of said operating air pressure chamber; a first constrictor element; and a second constrictor element; said operating air pressure intake port of said atmospheric pressure compensation valve being communicated via said first constrictor element to said operating air pressure chamber and also being communicated via said second constrictor element to said second control valve port, while said operating air pressure output port of said atmospheric pressure compensation valve is communicated to said second control valve port.

7. An exhaust gas recirculation control system according to any one of claims 1 through 4, wherein said operating air pressure control valve comprises: a casing formed with an interior cavity; a diaphragm which separates said interior cavity into an operating air pressure chamber and an atmospheric pressure chamber; a control valve port which opens into said operating air pressure chamber; a passage leading from said atmospheric pressure chamber to the atmosphere with substantially no flow resistance being interposed between said atmospheric pressure chamber and the atmosphere; a valve body fixed to said diaphragm; a communication valve mounted in said valve body which confronts said control valve port and which selectively provides communication between said operating air pressure chamber and said atmospheric pressure chamber; a means for biasing said communication valve in its direction to approach said control valve port by an amount which depends upon the load on said diesel internal combustion engine; said operating air pressure intake port of said operating air pressure control valve being communicated to said control valve port, while said operating air pressure output port of said operating air pressure control valve is communicated to said operating air pressure chamber; said communication valve being closed when said control valve port is not pressing thereon, so as to interrupt communication between said atmospheric pressure chamber and said operating air pressure chamber, and being opened so as to allow communication between said atmospheric pressure chamber and said operating air pressure chamber when said control valve port is pressing thereon and then closing said control valve port so as to interrupt communication between said operating air pressure intake port and said operating air pressure chamber.

8. An exhaust gas recirculation control system according to claim 7, wherein said means for biasing said communication valve comprises a spring one end of which bears upon said valve body while the other end thereof is moved according to the load on said diesel internal combustion engine.

9. An exhaust gas recirculation control system according to claim 8, further comprising a cam which supports said other end of said spring and which is moved according to the load on said diesel internal combustion engine.

10. An exhaust gas recirculation control system according to claim 7, wherein said communication valve comprises a valve element and a spring both of which are mounted in a through hole in said valve body which opens between said operating air pressure chamber and said atmospheric pressure chamber, said spring biasing said valve element against a valve seat formed on the interior surface of said through hole so as to interrupt communication through said through hole between said operating air pressure chamber and said atmospheric pressure chamber when said control valve port is not pressing on said valve element, and said control valve port otherwise pressing said valve element away from said valve seat against the biasing resistance of said spring which is overcome so as to establish communication through said through hole between said operating air pressure chamber and said atmospheric pressure chamber, said control valve port being simultaneously closed by its said pressing on said valve element so as to interrupt communication between said intake valve port of said operating air pressure control valve and said operating air pressure chamber.

* * * * *